US011194262B2

(12) United States Patent
Matsumoto

(10) Patent No.: US 11,194,262 B2
(45) Date of Patent: Dec. 7, 2021

(54) IMAGE FORMING APPARATUS AND IMAGE FORMING METHOD

(71) Applicant: Oki Electric Industry Co., Ltd., Tokyo (JP)

(72) Inventor: Hayato Matsumoto, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 16/847,877

(22) Filed: Apr. 14, 2020

(65) Prior Publication Data

US 2020/0341397 A1 Oct. 29, 2020

(30) Foreign Application Priority Data

Apr. 23, 2019 (JP) ..... JP2019-082265

(51) Int. Cl.

| | |
|---|---|
| ***G03G 15/00*** | (2006.01) |
| ***G03G 9/09*** | (2006.01) |
| ***G03G 15/01*** | (2006.01) |
| ***G03G 9/08*** | (2006.01) |

(52) U.S. Cl.

CPC ..... *G03G 9/0926* (2013.01); *G03G 9/0819* (2013.01); *G03G 9/0827* (2013.01); *G03G 15/0121* (2013.01); *G03G 2215/00029* (2013.01)

(58) Field of Classification Search

CPC ..... G03G 15/0121; G03G 2215/00029; G03G 9/0926; G03G 9/0827

See application file for complete search history.

(56) References Cited

U.S. PATENT DOCUMENTS

| | | | | |
|---|---|---|---|---|
| 2018/0143553 | A1* | 5/2018 | Kuwabara ..... | G03G 9/08782 |
| 2018/0217535 | A1* | 8/2018 | Koido ..... | G03G 15/6585 |
| 2019/0094787 | A1* | 3/2019 | Anno ..... | G03G 21/0047 |

FOREIGN PATENT DOCUMENTS

| | | | |
|---|---|---|---|
| JP | 2014-235382 | A | 12/2014 |

* cited by examiner

*Primary Examiner* — Mark A Chapman
(74) *Attorney, Agent, or Firm* — Muncy, Geissler, Olds & Lowe, P.C.

(57) ABSTRACT

An image forming apparatus includes a brilliant image forming part that forms a brilliant toner image using a brilliant toner, a color image forming part that forms a color toner image using a color toner, and a controller that controls a brilliant deposition amount of the brilliant toner and a color deposition amount of the color toner on a medium, wherein when the brilliant toner image is to be superimposed over the color toner image on the medium, the controller adjusts the brilliant deposition amount for the brilliant toner image in correspondence with a color type and the color deposition amount of the color toner that has been used for the color toner image.

19 Claims, 15 Drawing Sheets

| | Brilliant Toner | Alminum Content [%] | Brilliance |
|---|---|---|---|
| Exam. 1 | TSa | 15.5 | ○ |
| C.Exam. 1 | TSb | 3.5 | × |
| Exam. 2 | TSc | 6.7 | ○ |
| Exam. 3 | TSd | 10.0 | ○ |
| Exam. 4 | TSe | 17.0 | ○ |
| Exam. 5 | TSf | 17.2 | ○ |
| C.Exam. 2 | TSg | 19.6 | × |

"C.Exam." means Comparative Example

| | On Medium Deposition Amount [mg/cm² ] | | | | | |
|---|---|---|---|---|---|---|
| | 0.01 | 0.02 | 0.03 | 0.04 | 0.05 | 0.06 |
| Brilliant Toner TS (TSa~TSg) | × | × | ○ | ○ | ○ | ○ |
| Black Toner TK | × | × | × | ○ | ○ | ○ |
| Yellow Toner TY | × | × | × | ○ | ○ | ○ |
| Magenta Toner TM | × | × | × | ○ | ○ | ○ |
| Cyan Toner TC | × | × | × | ○ | ○ | ○ |

*Fig. 9*

| Brilliant Deposition Amount MS [mg/cm² ] | Yellow Deposition Amount MY [mg/cm² ] | Total Deposition Amount U (=MS+MY) | Deposition Amount Ratio R (=MY/MS) | Metallic Color Expressibility |
|---|---|---|---|---|
| 0.03 | 0.10 | 0.13 | 3.33 | × |
| 0.03 | 0.14 | 0.17 | 4.67 | ○ |
| 0.03 | 0.23 | 0.26 | 7.67 | ○ |
| 0.03 | 0.35 | 0.38 | 11.67 | ○ |
| 0.03 | 0.43 | 0.46 | 14.33 | × |
| 0.12 | 0.10 | 0.22 | 0.83 | × |
| 0.12 | 0.14 | 0.26 | 1.17 | ◎ |
| 0.12 | 0.23 | 0.35 | 1.92 | ◎ |
| 0.12 | 0.35 | 0.47 | 2.92 | ◎ |
| 0.12 | 0.43 | 0.55 | 3.58 | × |
| 0.22 | 0.10 | 0.32 | 0.45 | × |
| 0.22 | 0.14 | 0.36 | 0.63 | × |
| 0.22 | 0.23 | 0.45 | 1.05 | × |
| 0.22 | 0.35 | 0.57 | 1.59 | × |
| 0.22 | 0.43 | 0.65 | 1.95 | × |
| 0.36 | 0.10 | 0.46 | 0.28 | × |
| 0.36 | 0.14 | 0.50 | 0.39 | × |
| 0.36 | 0.23 | 0.59 | 0.64 | × |
| 0.36 | 0.35 | 0.71 | 0.97 | × |
| 0.36 | 0.43 | 0.79 | 1.19 | × |
| 0.45 | 0.10 | 0.55 | 0.22 | × |
| 0.45 | 0.14 | 0.59 | 0.31 | × |
| 0.45 | 0.23 | 0.68 | 0.51 | × |
| 0.45 | 0.35 | 0.80 | 0.78 | × |
| 0.45 | 0.43 | 0.88 | 0.96 | × |

| Brilliant Deposition Amount MS [mg/cm²] | Yellow Deposition Amount MY [mg/cm²] | Total Deposition Amount U (=MS+MS) | Deposition Amount Ratio R (=MY/MS) | Metallic Color Expressibility |
|---|---|---|---|---|
| 0.21 | 0.21 | 0.42 | 1.00 | × |
| 0.03 | 0.04 | 0.07 | 1.17 | ○ |
| 0.10 | 0.12 | 0.22 | 1.17 | ◎ |
| 0.21 | 0.25 | 0.46 | 1.17 | ◎ |
| 0.26 | 0.30 | 0.56 | 1.17 | × |
| 0.33 | 0.39 | 0.72 | 1.17 | × |
| 0.35 | 0.41 | 0.76 | 1.17 | × |
| 0.03 | 0.09 | 0.12 | 2.92 | ◎ |
| 0.09 | 0.26 | 0.35 | 2.92 | ◎ |
| 0.12 | 0.35 | 0.47 | 2.92 | ◎ |
| 0.15 | 0.45 | 0.60 | 2.92 | × |
| 0.18 | 0.54 | 0.72 | 2.92 | × |
| 0.19 | 0.57 | 0.76 | 2.92 | × |
| 0.11 | 0.34 | 0.45 | 3.09 | × |

*Fig. 12*

| Brilliant Deposition Amount MS [mg/cm²] | Black Deposition Amount MK [mg/cm²] | Total Deposition Amount U (=MS+MK) | Deposition Amount Ratio R (=MK/MS) | Metallic Color Expressibility |
|---|---|---|---|---|
| 0.03 | 0.22 | 0.25 | 7.33 | × |
| 0.03 | 0.28 | 0.31 | 9.33 | × |
| 0.03 | 0.33 | 0.36 | 11.0 | × |
| 0.03 | 0.40 | 0.43 | 13.3 | × |
| 0.03 | 0.46 | 0.49 | 15.3 | × |
| 0.12 | 0.22 | 0.34 | 1.83 | × |
| 0.12 | 0.28 | 0.40 | 2.33 | ○ |
| 0.12 | 0.33 | 0.45 | 2.75 | ○ |
| 0.12 | 0.40 | 0.52 | 3.33 | × |
| 0.12 | 0.46 | 0.58 | 3.83 | × |
| 0.22 | 0.22 | 0.44 | 1.00 | × |
| 0.22 | 0.28 | 0.50 | 1.27 | ○ |
| 0.22 | 0.33 | 0.55 | 1.50 | ○ |
| 0.22 | 0.40 | 0.62 | 1.82 | × |
| 0.22 | 0.46 | 0.68 | 2.09 | × |
| 0.36 | 0.22 | 0.58 | 0.61 | × |
| 0.36 | 0.28 | 0.64 | 0.78 | ○ |
| 0.36 | 0.33 | 0.69 | 0.92 | ○ |
| 0.36 | 0.40 | 0.76 | 1.11 | × |
| 0.36 | 0.46 | 0.82 | 1.28 | × |
| 0.45 | 0.22 | 0.67 | 0.49 | × |
| 0.45 | 0.28 | 0.78 | 0.62 | × |
| 0.45 | 0.33 | 0.73 | 0.73 | × |
| 0.45 | 0.40 | 0.91 | 0.89 | × |
| 0.45 | 0.46 | 0.85 | 1.02 | × |

| Brilliant Deposition Amount MS [mg/cm²] | Black Deposition Amount MK [mg/cm²] | Total Deposition Amount U (=MS+MK) | Deposition Amount Ratio R (=MK/MS) | Metallic Color Expressibility |
|---|---|---|---|---|
| 0.23 | 0.28 | 0.51 | 1.22 | × |
| 0.03 | 0.04 | 0.07 | 1.27 | ○ |
| 0.09 | 0.11 | 0.20 | 1.27 | ○ |
| 0.14 | 0.18 | 0.32 | 1.27 | ○ |
| 0.22 | 0.28 | 0.50 | 1.27 | ○ |
| 0.30 | 0.38 | 0.68 | 1.27 | ○ |
| 0.33 | 0.42 | 0.75 | 1.27 | × |
| 0.03 | 0.05 | 0.08 | 1.50 | ○ |
| 0.10 | 0.15 | 0.25 | 1.50 | ○ |
| 0.13 | 0.24 | 0.40 | 1.50 | ○ |
| 0.23 | 0.35 | 0.58 | 1.50 | ○ |
| 0.28 | 0.41 | 0.69 | 1.50 | ○ |
| 0.33 | 0.50 | 0.83 | 1.50 | × |
| 0.21 | 0.36 | 0.57 | 1.71 | × |

*Fig. 15*

| Brilliant Deposition Amount MS [mg/cm² ] | Magenta Deposition Amount MM [mg/cm² ] | Total Deposition Amount U (=MS+MM) | Deposition Amount Ratio R (=MK/MM) | Metallic Color Expressibility |
|---|---|---|---|---|
| 0.03 | 0.24 | 0.27 | 8.0 | × |
| 0.03 | 0.29 | 0.32 | 9.67 | × |
| 0.03 | 0.33 | 0.36 | 11.0 | × |
| 0.03 | 0.41 | 0.44 | 13.67 | × |
| 0.03 | 0.48 | 0.51 | 16.0 | × |
| 0.12 | 0.24 | 0.36 | 2.00 | × |
| 0.12 | 0.29 | 0.41 | 2.42 | ○ |
| 0.12 | 0.33 | 0.45 | 2.75 | ○ |
| 0.12 | 0.41 | 0.53 | 3.42 | × |
| 0.12 | 0.48 | 0.6 | 4.00 | × |
| 0.22 | 0.24 | 0.46 | 1.09 | × |
| 0.22 | 0.29 | 0.51 | 1.32 | ○ |
| 0.22 | 0.33 | 0.55 | 1.50 | ○ |
| 0.22 | 0.41 | 0.63 | 1.86 | × |
| 0.22 | 0.48 | 0.7 | 2.18 | × |
| 0.36 | 0.24 | 0.6 | 0.67 | × |
| 0.36 | 0.29 | 0.65 | 0.81 | ○ |
| 0.36 | 0.33 | 0.69 | 0.92 | ○ |
| 0.36 | 0.41 | 0.77 | 1.14 | × |
| 0.36 | 0.48 | 0.84 | 1.33 | × |
| 0.45 | 0.24 | 0.69 | 0.53 | × |
| 0.45 | 0.29 | 0.74 | 0.64 | × |
| 0.45 | 0.33 | 0.78 | 0.73 | × |
| 0.45 | 0.41 | 0.86 | 0.91 | × |
| 0.45 | 0.48 | 0.93 | 1.07 | × |

| Brilliant Deposition Amount MS [mg/cm²] | Magenta Deposition Amount MM [mg/cm²] | Total Deposition Amount U (=MS+MM) | Deposition Amount Ratio R (=MM/MS) | Metallic Color Expressibility |
|---|---|---|---|---|
| 0.18 | 0.23 | 0.41 | 1.28 | × |
| 0.03 | 0.04 | 0.07 | 1.32 | ○ |
| 0.10 | 0.13 | 0.23 | 1.32 | ○ |
| 0.17 | 0.22 | 0.39 | 1.32 | ○ |
| 0.23 | 0.30 | 0.53 | 1.32 | ○ |
| 0.30 | 0.40 | 0.70 | 1.32 | × |
| 0.36 | 0.48 | 0.84 | 1.32 | × |
| 0.04 | 0.06 | 0.10 | 1.50 | ○ |
| 0.09 | 0.14 | 0.23 | 1.50 | ○ |
| 0.17 | 0.26 | 0.43 | 1.50 | ○ |
| 0.21 | 0.32 | 0.53 | 1.50 | ○ |
| 0.28 | 0.41 | 0.69 | 1.50 | ○ |
| 0.34 | 0.51 | 0.85 | 1.50 | × |
| 0.22 | 0.35 | 0.57 | 1.59 | × |

*Fig. 18*

| Brilliant Deposition Amount MS [mg/cm²] | Cyan Deposition Amount MC [mg/cm²] | Total Deposition Amount U (=MS+MC) | Deposition Amount Ratio R (=MC/MM) | Metallic Color Expressibility |
|---|---|---|---|---|
| 0.03 | 0.18 | 0.21 | 6.00 | × |
| 0.03 | 0.26 | 0.29 | 8.67 | × |
| 0.03 | 0.36 | 0.39 | 12.0 | × |
| 0.03 | 0.47 | 0.50 | 15.67 | × |
| 0.03 | 0.55 | 0.58 | 18.3 | × |
| 0.12 | 0.18 | 0.30 | 1.50 | × |
| 0.12 | 0.26 | 0.38 | 2.17 | ○ |
| 0.12 | 0.36 | 0.48 | 3.00 | ○ |
| 0.12 | 0.47 | 0.59 | 3.92 | × |
| 0.12 | 0.55 | 0.67 | 4.58 | × |
| 0.22 | 0.18 | 0.40 | 0.82 | × |
| 0.22 | 0.26 | 0.48 | 1.18 | ○ |
| 0.22 | 0.36 | 0.58 | 1.64 | ○ |
| 0.22 | 0.47 | 0.69 | 2.14 | × |
| 0.22 | 0.55 | 0.77 | 2.50 | × |
| 0.36 | 0.18 | 0.54 | 0.50 | × |
| 0.36 | 0.26 | 0.62 | 0.72 | ○ |
| 0.36 | 0.36 | 0.72 | 1.00 | ○ |
| 0.36 | 0.47 | 0.83 | 1.31 | × |
| 0.36 | 0.55 | 0.91 | 1.53 | × |
| 0.45 | 0.18 | 0.63 | 0.40 | × |
| 0.45 | 0.26 | 0.71 | 0.58 | × |
| 0.45 | 0.36 | 0.81 | 0.80 | × |
| 0.45 | 0.47 | 0.92 | 1.04 | × |
| 0.45 | 0.55 | 1.00 | 1.22 | × |

| Brilliant Deposition Amount MS [mg/cm²] | Cyan Deposition Amount MC [mg/cm²] | Total Deposition Amount U (=MS+MC) | Deposition Amount Ratio R (=MC/MS) | Metallic Color Expressibility |
|---|---|---|---|---|
| 0.23 | 0.25 | 0.48 | 1.09 | × |
| 0.03 | 0.04 | 0.07 | 1.18 | ○ |
| 0.11 | 0.13 | 0.24 | 1.18 | ○ |
| 0.16 | 0.19 | 0.35 | 1.18 | ○ |
| 0.24 | 0.28 | 0.52 | 1.18 | ○ |
| 0.31 | 0.37 | 0.68 | 1.18 | ○ |
| 0.34 | 0.40 | 0.74 | 1.18 | × |
| 0.03 | 0.05 | 0.08 | 1.64 | ○ |
| 0.10 | 0.16 | 0.26 | 1.64 | ○ |
| 0.17 | 0.28 | 0.45 | 1.64 | ○ |
| 0.22 | 0.36 | 0.58 | 1.64 | ○ |
| 0.27 | 0.44 | 0.72 | 1.64 | ○ |
| 0.35 | 0.57 | 0.92 | 1.64 | × |
| 0.21 | 0.38 | 0.59 | 1.81 | × |

*Fig. 22*

TBL1

| | Total Deposition Amount U (=MS+ML) | Deposition Amount Ratio R (=ML/MS) |
|---|---|---|
| Yellow Toner TY | $0.07 \leqq (MS+MY) \leqq 0.47$ | $1.17 \leqq (MY/MS) \leqq 2.92$ |
| Black Toner TK | $0.07 \leqq (MS+MK) \leqq 0.69$ | $1.27 \leqq (MK/MS) \leqq 1.50$ |
| Magenta Toner TM | $0.07 \leqq (MS+MM) \leqq 0.69$ | $1.32 \leqq (MM/MS) \leqq 1.50$ |
| Cyan Toner TC | $0.07 \leqq (MS+MC) \leqq 0.72$ | $1.18 \leqq (MC/MS) \leqq 1.64$ |
| Color Toner TL | $0.07 \leqq (MS+ML) \leqq 0.47$ | $1.32 \leqq (ML/MS) \leqq 1.50$ |

IMAGE FORMING APPARATUS AND IMAGE FORMING METHOD

TECHNOLOGY FIELD

This invention relates to an image forming apparatus and an image forming method that are suitable for applying to an electrophotographic printer for example.

BACKGROUND

Conventionally, widely used as an image forming apparatus (also called a printer) is one that performs a print process by forming a toner image by an image forming unit using a toner (also called a developer) based on an image supplied from a computer device etc., transfers it onto a medium such as a sheet of paper, and fusing it by applying heat and pressure. In an image forming apparatus, when performing general color printing, for example, toners of individual colors such as cyan, magenta, yellow, and black (these are hereafter called color toners) are used.

Also, among image forming apparatuses there is one that forms an image with high brilliance similar to metallic luster by superimposing a brilliant toner containing a metallic pigment such as aluminum on color toners. Further proposed as an image forming apparatus is one that expresses brilliance while maintaining color reproducibility of an image by limiting within a prescribed range a coverage that is the ratio of area covered with the brilliant toner of an image with color toners (e.g., see Patent Document 1).

RELATED ART

[Patent Doc.] JP Laid-Open Patent Application Publication 2014-235382

By the way, in an image forming apparatus, color shades can be expressed by increasing or decreasing the deposition amount of a color toner per unit area on a medium. That is, the image forming apparatus can express a denser color by increasing the deposition amount of the color toner per unit area, and a lighter color by decreasing the deposition amount.

However, there was a problem in an image forming apparatus that when expressing a dark color by increasing the deposition amount of the color toner per unit area, even if the coverage is set within the prescribed range, part of the brilliant toner superimposed on the color toner may be buried in the color toner, decreasing brilliance.

This invention has been made considering the above-mentioned point, and proposes an image forming apparatus and an image forming method that achieve both color reproducibility with color toners and brilliance with a brilliant toner.

SUMMARY

An image forming apparatus, disclosed in the application, for performing an image forming process, includes a brilliant image forming part that forms a brilliant toner image using a brilliant toner wherein the brilliant toner is used at a brilliant deposition amount (MS) for forming the brilliant toner image, the brilliant deposition amount being defined by a used weight of the brilliant toner per unit area, a color image forming part that forms a color toner image using a color toner wherein the color toner is used at a color deposition amount (ML) for forming the color toner image, the color deposition amount being defined by a used weight of the color toner per unit area, a transfer part that transfers the brilliant toner image and the color toner image to a medium, and a controller that controls the brilliant deposition amount of the brilliant toner and the color deposition amount of the color toner on the medium, wherein when the brilliant toner image is to be superimposed over the color toner image on the medium, the controller adjusts the brilliant deposition amount for the brilliant toner image in correspondence with a color type and the color deposition amount ML of the color toner that has been used for the color toner image.

Another image forming apparatus for performing an image forming process includes a brilliant image forming part that forms a brilliant toner image using a brilliant toner wherein the brilliant toner is used at a brilliant deposition amount (MS) for forming the brilliant toner image, the brilliant deposition amount being defined by a used weight of the brilliant toner per unit area, a color image forming part that forms a color toner image using a color toner wherein the color toner is used at a color deposition amount (ML) for forming the color toner image, the color deposition amount being defined by a used weight of the color toner per unit area, a transfer part that transfers the brilliant toner image and the color toner image to a medium, and a controller that controls the brilliant deposition amount of the brilliant toner and the color deposition amount of the color toner on the medium, wherein in a case where the brilliant toner image is to be superimposed over the color toner image on the medium, the brilliant deposition amount MS is 0.03 [mg/cm$^2$] or higher, and the color deposition amount ML is 0.04 [mg/cm$^2$] or higher, the controller performs the image forming process to satisfy following equations (1) and (2):

$$1.17 \leq ML/MS \leq 2.92 \quad (1)$$

$$0.07 \leq MS+ML \leq 0.72 \quad (2).$$

An image forming method, disclosed in the application, for superimposing a brilliant toner image using a brilliant toner over a color toner image using a color toner on a medium includes an acquisition step that acquires a color type of the color toner and a color deposition amount (ML) that is defined by a used weight of the color toner per unit area, which has been used on the medium, and a determination step that determines a brilliant deposition amount (MS) that is defined by a used weight of the brilliant toner per unit area, which is to be used on the medium in consideration of the color type of the color toner and the color deposition amount, an adjustment step that adjusts an absolute value of bias voltage to be applied to form the brilliant toner image, and a forming step that forms the brilliant toner image over the color toner image using the bias voltage, which is adjusted at the adjustment step, such that the brilliant deposition amount of the brilliant toner over the color toner either increases or decreases in correspondence with the bias voltage.

Because this invention performs a control so as to determine a brilliant deposition amount MS according to the color and color deposition amount ML of a color toner, it can prevent the color toner from becoming too much, causing a brilliant toner to be buried in the color toner, and decreasing brilliance, or becoming too little and decreasing color reproducibility.

This invention can realize an image forming apparatus and an image forming method that achieve both color reproducibility with color toners and brilliance with a brilliant toner.

BRIEF DESCRIPTION OF THE DRAWINGS

FIG. 9 is a table listing evaluations on metallic color expressibility when using the yellow toner.

FIG. 12 is a table listing metallic color expressibility evaluations when using the black toner.

FIG. 15 is a table listing metallic color expressibility evaluations when using the magenta toner.

FIG. 18 is a table listing metallic color expressibility evaluations when using the cyan toner.

FIG. 22 is a table showing the configuration of a control table.

DETAILED DESCRIPTION OF PREFERRED EMBODIMENT(S)

Below, modes for implementing the invention (hereafter called embodiments) are explained referring to drawings.

1. Configuration of Image Forming Apparatus

Figure 1:
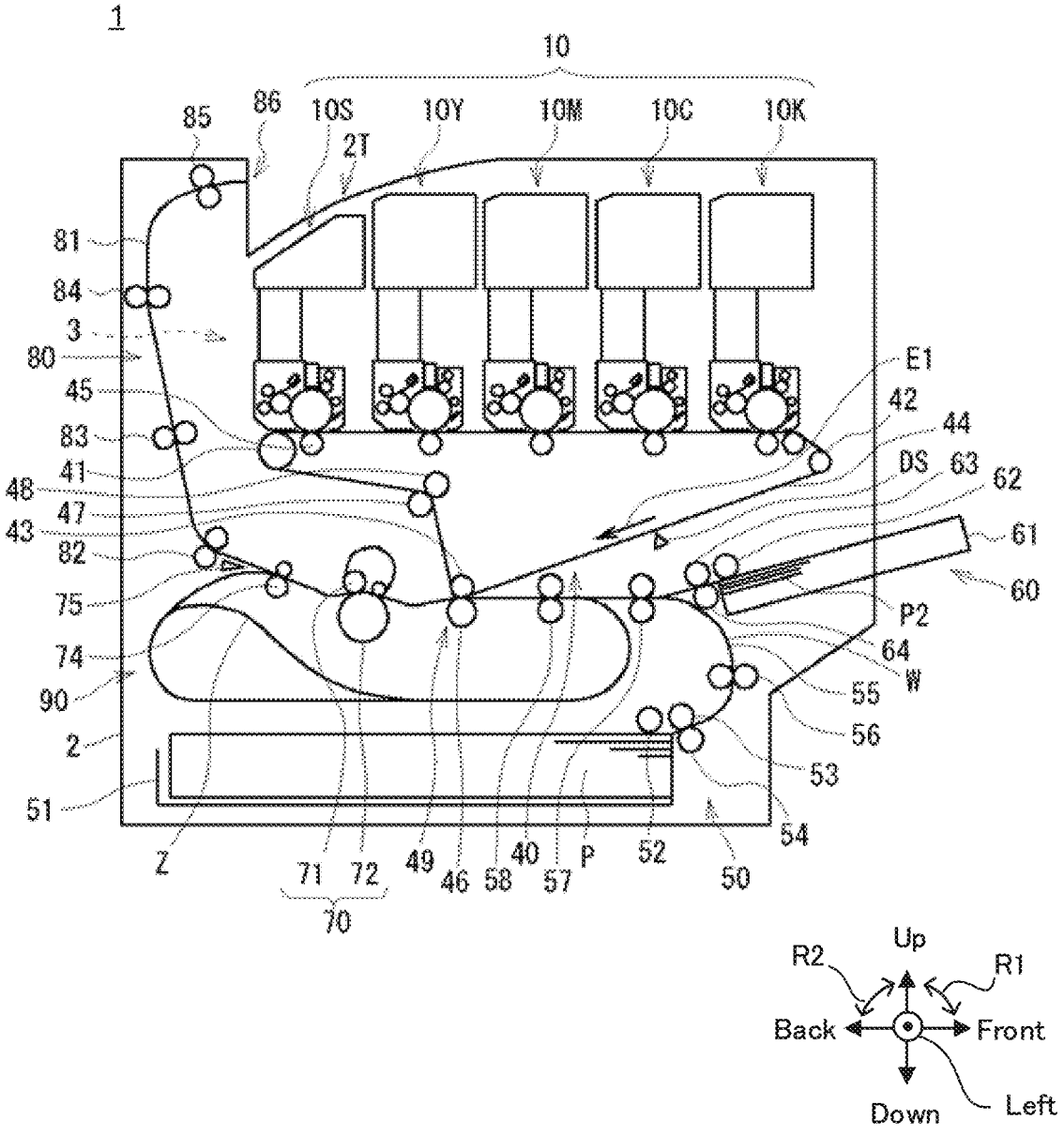
FIG. 1 is a schematic diagram showing the configuration of an image forming apparatus.

As its schematic side view is shown in FIG. 1, an image forming apparatus 1 by this embodiment is an electrophotographic color printer and can form (that is, print) a color image on a sheet P as a medium. Incidentally, the image forming apparatus 1 does not have an image scanning function to read a manuscript, a communication function using a telephone line, or the like, and is an SFP (Single Function Printer) having only a printer function.

The image forming apparatus 1 has various parts disposed inside a chassis 2 formed in an approximate box shape. Incidentally, explanations below are given by regarding the right end part in FIG. 1 as the front of the image forming apparatus 1, and defining the up-down direction, the right-left direction, and the front-back direction when viewed facing this front.

The image forming apparatus 1 is designed to control the whole in an integrated manner by a controller 3. This controller 3 has a CPU (Central Processing Unit), ROM (Read Only Memory), RAM (Random Access Memory), etc. that are not shown, and performs various processes by reading and executing prescribed programs. Also, the controller 3 is connected wirelessly or by wire with a higher-level device such as a computer (not shown), and upon receiving image data expressing a print target image and an instruction to print the image data from this higher-level device, performs a print process that forms a printed image on the surface of the sheet P.

Disposed in the upper side inside the chassis 2 are five image forming units 10K, 10C, 10M, 10Y, and 10S sequentially from the front side toward the back side. Although the image forming units 10K, 10C, 10M, 10Y, and 10S correspond to black (K), cyan (C), magenta (M), yellow (Y), and a special color (S), they are all configured in the same manner, differing only in color.

Black (K), cyan (C), magenta (M), and yellow (Y) are all colors used in a commonly-used color printer (hereafter, they are called normal colors). On the other hand, the special color (S) is a special color such as gold or silver, exhibiting metallic luster, that is, having brilliance. Other than a standalone use, this special color may be used superimposed on a normal color. In this embodiment, explained as an example is a case where silver is used as the special color. For convenience of explanation, the image forming units 10K, 10C, 10M, 10Y, and 10S are also collectively called image forming units 10. Also below, the image forming units 10K, 10C, 10M, and 10Y are also called color image forming units, and further the image forming unit 10S is also called a brilliant image forming unit.

Figure 2:
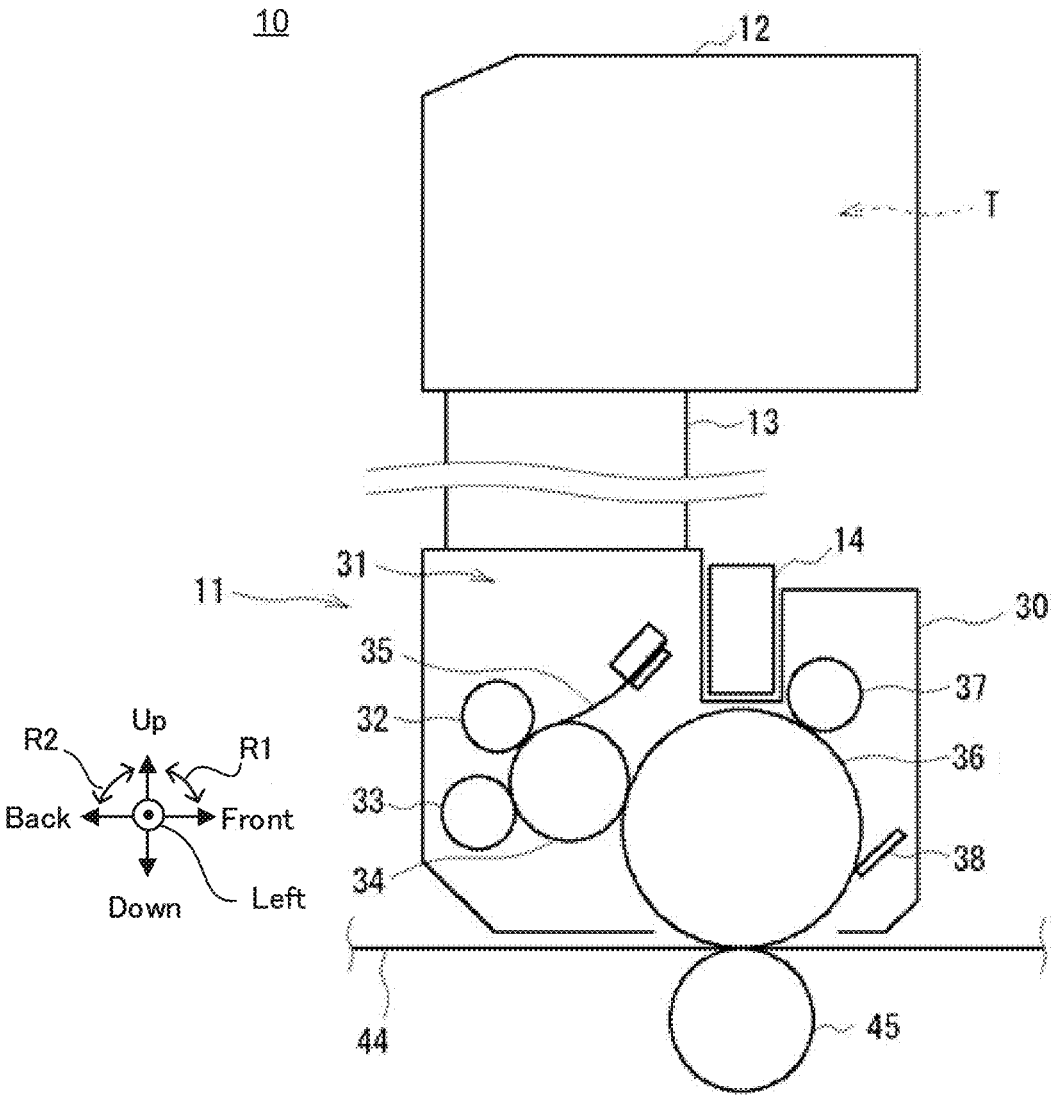
FIG. 2 is a schematic diagram showing the configuration of an image forming unit.

As shown in FIG. 2, the image forming unit 10 is roughly configured of an image forming main body part 11, a toner container 12, a toner supply part 13, and an LED (Light Emitting Diode) head 14. Incidentally, the image forming unit 10 and the individual parts constituting it have a sufficient length in the right-left direction corresponding to the right-left length of the sheet P. Therefore, many parts have relatively a greater right-left direction length than its front-back direction or up-down direction length, formed in a shape elongated along the right-left direction.

The toner container 12 internally accommodates a toner T and is configured detachably from the image forming unit 10. When this toner container 12 is installed to the image forming unit 10, it is attached to the image forming main body part 11 through the toner supply part 13.

Figure 3:
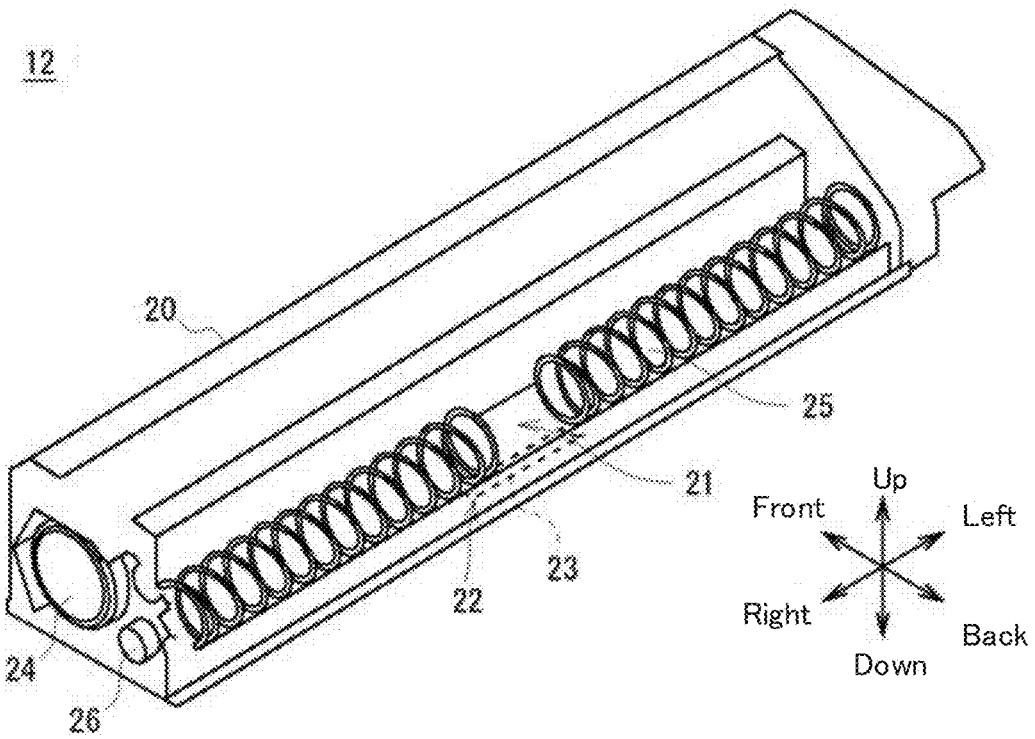
FIG. 3 is a schematic perspective view showing the configuration of a toner container.

As a schematic perspective view is shown in FIG. 3, the toner container 12 has an accommodating chamber 21 made of a cylindrical space elongated in the right-left direction formed inside a container chassis 20 elongated in the right-left direction, and the toner T is accommodated in this accommodating chamber 21. This toner container 12 may occasionally be called a toner cartridge.

Incidentally, used as the silver toner T is a toner containing a brilliant pigment. For convenience of explanation, the silver toner T is hereafter also called a brilliant toner TS. Also, used as the yellow, magenta, cyan, and black toners T are toners containing organic pigments such as pigment yellow, pigment cyan, pigment magenta, and carbon black. For convenience of explanation, the yellow, magenta, cyan, and black toners T are hereafter also collectively called color toners TL. Furthermore, the yellow, magenta, cyan, and black color toners TL are hereafter also called a yellow toner TY, a magenta toner TM, a cyan toner TC, and a black toner TK.

In approximately the center of the right-left direction on the bottom part of the accommodating chamber 21, drilled is a supply hole 22 that communicates space inside the accommodating chamber 21 and outside space, and installed is a shutter 23 that opens or closes the supply hole 22. This shutter 23 is connected with a lever 24, and the supply hole 22 can be opened or closed accompanying the rotation of the lever 24. This lever 24 is operated by a user when the toner container 12 is attached to or detached from the image forming unit 10.

For example, in a state before the toner container 12 is installed to the image forming unit 10 (FIG. 2), the supply hole 22 is closed with the shutter 23 in advance, preventing the toner T accommodated inside the accommodating chamber 21 from leaking to the outside. When the toner container 12 is installed to the image forming unit 10, by the lever 24 being rotated in a prescribed opening direction, the shutter 23 is moved to open the supply hole 22. Thereby, the toner container 12 communicates space inside the accommodating chamber 21 with space inside the toner supply part 13, allowing the toner T inside the accommodating chamber 21 to be supplied to the image forming main body part 11 via the toner supply part 13. Also, when the toner container 12 is detached from the image forming unit 10, by lever 24 being rotated in a prescribed closing direction, the shutter 23 is moved to close the supply hole 22.

Also, installed inside the accommodating chamber 21 is a stirring member 25. The stirring member 25 is formed in a shape that a thin elongated member is wound spirally around a virtual central shaft along the right-left direction, so that it can rotated centering on this virtual central shaft inside the accommodating chamber. Installed on an end part of the container chassis 20 is a stirring drive part 26. The stirring drive part 26 is coupled with the stirring member 25, and once a drive force is supplied from a prescribed drive force source installed inside the chassis 2 (FIG. 1), transmits this drive force to the stirring member 25, having it rotate. Thereby, the toner container 12 can stir the toner T accommodated inside the accommodating chamber 21, preventing agglomeration of the toner T and sending the toner T to the supply hole 22.

Built in the image forming main body part 11 (FIG. 2) are an image forming chassis 30, a toner accommodating space 31, a first supply roller 32, a second supply roller 33, a development roller 34, a development blade 35, a photosensitive drum 36, a charging roller 37, and a cleaning blade 38. Among them, the first supply roller 32, the second supply roller 33, the development roller 34, the photosensitive drum 36, and the charging roller 37 are each configured in a columnal shape having the central axis along the right-left direction and supported rotatably by the image forming chassis 30.

Incidentally, in the image forming unit 10S of the special color (S), the toner container 12 accommodating a toner T of a color (such as gold or silver) selected by the user in advance is installed to the image forming main body part 11 through the toner supply part 13.

The toner accommodating space 31 accommodates the toner T supplied through the toner supply part 13 from the toner container 12. Each of the first supply roller 32 and the second supply roller 33 has an elastic layer made of a conductive urethane rubber foam or the like formed on the circumferential side face. The development roller 34 has an elastic layer having elasticity, a surface layer having conductivity, etc. formed on the circumferential side face. The development blade 35 is made of a stainless steel plate of a prescribed thickness for example, and has its part in contact with the circumferential side face of the development roller 34 in a slightly elastically-deformed state.

The photosensitive drum 36 has a charge generation layer and a charge transportation layer as thin films formed sequentially on the circumferential side face so as to allow being charged. The charging roller 37 has its circumferential side face coated with a conductive elastic body, and has this circumferential side face in contact with the circumferential side face of the photosensitive drum 36. The cleaning blade 38 is made of a resin in a thin-plate shape for example, and has its part in contact with the circumferential side face of the photosensitive drum 36 in a slightly elastically-deformed state.

The LED head 14 is positioned above the photosensitive drum 36 in the image forming main body part 11. This LED head 14 has a plurality of light-emitting element chips disposed linearly along the right-left direction, and has the individual light-emitting elements emit light in a light-emitting pattern based on an image data signal supplied from the controller 3 (FIG. 1).

By a drive force being supplied from an unshown motor, the image forming main body part 11 rotates the first supply roller 32, the second supply roller 33, the development roller 34, and the charging roller 37 in an arrow R1 direction (clockwise in the figure), and also rotates the photosensitive drum 36 in an arrow R2 direction (anticlockwise in the figure). Furthermore, based on the control of the controller 3, the image forming main body part 11 applies respectively prescribed bias voltages to the first supply roller 32, the second supply roller 33, the development roller 34, the development blade 35, and the charging roller 37, having them charged.

By being charged, the first supply roller 32 and the second supply roller 33 have the toner T inside the toner accommodating space 31 adhere to their circumferential side faces, and have this toner T adhere to the circumferential side face of the development roller 34 by rotating. The development roller 34 has the excess toner T removed from its circumferential side face by the development blade 35, making a state where the toner T is adhering in a thin film shape, and has this circumferential side face contact the circumferential side face of the photosensitive drum 36.

On the other hand, the charging roller 37 contacts the photosensitive drum 36 in a charged state, thereby uniformly charging the circumferential side face of the photosensitive drum 36. The LED head 14 emits light at every prescribed time interval in the light-emitting pattern based on the image data signal supplied from the controller 3 (FIG. 1), thereby exposing the photosensitive drum 36 in order. Thereby, an electrostatic latent image is formed in order near the upper end of the circumferential side face of the photosensitive drum 36

Subsequently, the photosensitive drum 36 rotates in the arrow R2 direction, thereby bringing the part where this electrostatic latent image is formed into contact with the development roller 34. Thereby, on the circumferential side face of the photosensitive drum 36, the toner T adheres based on the electrostatic latent image, developing a toner image based on the image data. The photosensitive drum 36 further rotates in the arrow R2 direction, thereby having the toner image reach the lower end vicinity of the photosensitive drum 36. For convenience of explanation, hereafter, a toner image formed with the brilliant toner TS is also called a brilliant toner image IS, and a toner image formed with the color toner TL is also called a color toner image IL.

Disposed below the image forming units 10 inside the chassis 2 (FIG. 1) is an intermediate transfer part 40. Installed in the intermediate transfer part 40 are a drive roller 41, a driven roller 42, a backup roller 43, an intermediate transfer belt 44, five primary transfer rollers 45, a secondary transfer roller 46, and a reverse bending roller 47. Among these, the drive roller 41, the driven roller 42, the backup roller 43, the primary transfer rollers 45, the secondary transfer roller 46, and the reverse bending roller 47 are all formed in a columnal shape having the central axis along the right-left direction and supported rotatably by the chassis 2.

The drive roller 41 is disposed in the lower back side of the image forming unit 10S, and once a drive force is supplied from a not-shown belt motor, rotates in the arrow R1 direction. The driven roller 42 is disposed in the lower front side of the image forming unit 10K. The drive roller 41 and the driven roller 42 have their upper ends positioned at the same level or slightly below the lower end of the photosensitive drum 36 (FIG. 2) in each of the image forming units 10. The backup roller 43 is disposed in the lower front side of the drive roller 41 and the lower back side of the driven roller 42.

The intermediate transfer belt 44 is configured as an endless belt of a high-resistance plastic film and is stretched so as to run around the drive roller 41, the driven roller 42, and the backup roller 43. Furthermore, disposed in the intermediate transfer part 40 are the five primary transfer rollers 45 in positions below the part of the intermediate transfer belt 44 stretched between the drive roller 41 and the driven roller 42, that is, positions that are right under the five image forming units 10 and opposing the photosensitive drums 36 through the intermediate transfer belt 44, respectively. To these primary transfer rollers 45, one or more prescribed bias voltages are applied based on the control of the controller 3.

The secondary transfer roller 46 is positioned right under the backup roller 43, and is biased toward the backup roller 43. That is, the intermediate transfer part 40 has the intermediate transfer belt 44 nip-held between the secondary transfer roller 46 and the backup roller 43. Also, to the secondary transfer roller 46, a prescribed bias voltage is applied. Below, the secondary transfer roller 46 and the backup roller 43 are jointly called a secondary transfer part 49.

The reverse bending roller 47 is positioned in a place toward the lower front side of the drive roller 41 and toward the upper back side of the backup roller 43, and biases the intermediate transfer belt 44 in the upper front direction. Thereby, the intermediate transfer belt 44 has no slack occurring, and a tension acting between the rollers. Also, a reverse bending backup roller 48 is installed in the upper front side of the reverse bending roller 47, nipping the intermediate transfer belt 44.

The intermediate transfer part 40 rotates the drive roller 41 in the arrow R1 direction by a drive force supplied from an unshown belt motor, thereby having the intermediate transfer belt 44 travel in a direction along an arrow E1. Also, each of the primary transfer rollers 45 rotates in the arrow R1 direction in a state where the prescribed bias voltage is applied. Thereby, the image forming units 10 can transfer their respective toner images that reached the lower end vicinity on the circumferential side face of the photosensitive drums 36 (FIG. 2) to the intermediate transfer belt 44, sequentially superimposing the individual color toner images. At this time, on the surface of the intermediate transfer belt 44, the color toner images are sequentially superimposed starting with the upstream-side silver (S). The intermediate transfer part 40 has this intermediate transfer belt 44 travel, thereby having the toner image transferred from the image forming units 10 reach the vicinity of the backup roller 43.

By the way, formed inside the chassis 2 (FIG. 1) is a carrying route W that is a route for carrying the sheet P. This carrying route W runs from near the lower front toward the upper front inside the chassis 2, and after making approximately half a rotation, proceeds toward the back below the intermediate transfer part 40. Subsequently, the carrying route W heads upwards, proceeds upward in the back side of the intermediate transfer part 40 and the image forming unit 10S, and afterwards heads forward. That is, the carrying route W is formed as if drawing an English uppercase character "S" in FIG. 1. Inside the chassis 2, various parts are disposed along this carrying route W.

Disposed in the lower end vicinity inside the chassis 2 (FIG. 1) is a first sheet feeding part 50. Installed in the first sheet feeding part 50 are a sheet cassette 51, a pickup roller 52, a feed roller 53, a retard roller 54, a carrying guide 55, carrying roller pairs 56, 57, and 58, etc. Incidentally, the pickup roller 52, the feed roller 53, the retard roller 54, the carrying roller pairs 56, 57, and 58 are all formed in a columnar shape having the central axis along the right-left direction.

The sheet cassette 51 is configured in a hollow rectangular parallelopiped shape, and stores the sheets P overlaid with their sheet faces oriented in the up-down direction, that is, in a stacked state inside it. Also, the sheet cassette 51 is detachable from the chassis 2.

The pickup roller 52 is in contact with the front end vicinity on the top face of the sheets P stored in the sheet cassette 51. The feed roller 53 is disposed slightly forward away from the pickup roller 52. The retard roller 54 is positioned below the feed roller 53, forming space corresponding to the thickness of one piece of sheet P between it and the feed roller 53.

Once a drive force is supplied from a not-shown sheet feeding motor, the first sheet feeding part 50 rotates or stops the pickup roller 52, the feed roller 53, and the retard roller as appropriate. Thereby, the pickup roller 52 feeds forward one piece or more of the top face of the sheets P stored in the sheet cassette 51. Also, the feed roller 53 and the retard roller 54 further forward the one piece of the top face of the sheets P and blocks the second piece and thereafter on the other hand. In this manner, the first sheet feeding part 50 feeds forward the sheets P while separating them into individual pieces.

The carrying guide 55 is disposed in the lower front side part of the carrying route W, and has the sheet P proceed in the upper forward direction along this carrying route W, and further in the upper backward direction. The carrying roller pairs 56 and 57 are disposed near the center and in the upper end vicinity of the carrying guide 55, respectively, and rotate in a prescribed direction with a drive force supplied from an unshown sheet feeding motor. Thereby, the carrying roller pairs 56 and 57 have the sheet P proceed along the carrying route W.

Also, installed in the front side of the carrying roller pair 57 in the chassis 2 is a second sheet feeding part 60. Installed in the second sheet feeding part 60 are a sheet tray 61, a pickup roller 62, a feed roller 63, a retard roller 64, etc. The sheet tray 61 is formed in a plate shape that is thin in the up-down direction so as to have a sheet P2 loaded on its upper side. Incidentally, loaded on the sheet tray 61 is the sheet P2 that is different in size or paper quality from the sheet P stored in the sheet cassette 51 for example.

The pickup roller 62, the feed roller 63, and the retard roller 64 are configured in the same manner as the pickup roller 52, the feed roller 53, and the retard roller 54 of the first sheet feeding part 50, respectively. Once a drive force is supplied from a not-shown sheet feeding motor, the second sheet feeding part 60 rotates or stops the pickup roller 62, the feed roller 63, and the retard roller 64 as appropriate, thereby feeding backward one piece of the bottom face of the sheet P2 on the sheet tray 61 and blocks the second piece and thereafter. In this manner, the second sheet feeding part 60 feeds backward the sheets P2 while separating them into individual pieces. The sheet P2 fed at this time is carried along the carrying route W by the carrying roller pair 57 in the same manner as the sheet P. For convenience of explanation, the sheet P2 is simply called a sheet P without distinguishing it from the sheet P.

Incidentally, the carrying roller pair 57 has its rotation appropriately suppressed so as to apply a frictional force to the sheet P, thereby correcting so-called skew where sides of the sheet P are inclined relative to the procession direction and bringing it into a state where the leading and trailing edge sides align with the right-left direction, and then sends it backward. The carrying roller pair 58 is positioned in a place backward away by a prescribed interval from the carrying roller pair 57, and by rotating in the same manner as the carrying roller pair 56, supplies a drive force to the sheet P carried along the carrying route W, having the sheet P proceed further backward along the carrying route W.

Disposed in the back side of the carrying roller pair 58 is the above-mentioned secondary transfer part 49 of the intermediate transfer part 40, that is, the backup roller 43 and the secondary transfer roller 46. In this secondary transfer part 49, toner images that were formed in the image forming units 10 and transferred to the intermediate transfer belt 44 are adjacent with one another accompanying the travel of the intermediate transfer belt 44, and a prescribed bias voltage is applied to the secondary transfer roller 46. Therefore, the secondary transfer part 49 has the toner images transferred from the intermediate transfer belt 44 to the sheet P carried along the carrying route W and proceed further backward.

Also, installed in the image forming apparatus 1 is a density sensor DS in the lower back side of the driven roller 42. The density sensor DS detects the toner T densities in the toner images transferred to the surface of the intermediate transfer belt 44, and notifies the controller 3 of the obtained detection results. In response to this, the controller 3 performs density corrections to correct respectively the toner T densities in the individual color toner images formed in the image forming units 10, where feedback controls of the bias voltages etc. of the individual parts are performed so that the toner T densities become desired values.

Disposed in the back side of the secondary transfer part 49 is a fuser part 70. The fuser part 70 is configured of a heat application part 71 and a pressure application part 72 disposed opposing each other through the carrying route W. The heat application part 71 has a heater radiating heat, a plurality of rollers, etc. disposed inside a heat application belt made of a hollow endless belt. The pressure application part 72 is formed as a pressure application roller in a columnar shape having its central axis along the right-left direction, and presses its upper surface against the lower surface of the heat application part 71, forming a nip part.

Based on the control of the controller 3, this fuser part 70 heats the heater of the heat application part 71 to prescribed temperature and rotates the roller as appropriate so as to rotate the heat application belt in the arrow R1 direction, and rotates the pressure application part 72 in the arrow R2 direction. Moreover, upon receiving the sheet P to which the toner images are transferred by the secondary transfer part 49, the fuser part 70 nip-holds it with the heat application part 71 and the pressure application part 72, applies heat and pressure, fusing the toner images with the sheet P, and sends it backward.

Disposed in the back side of the fuser 70 is a carrying roller pair 74, and a switching part 75 is disposed in the back side of it. The switching part 75 switches the processing direction of the sheet P between upward and downward according to the control of the controller 3. Installed in the upper side of the switching part 75 is a sheet ejection part 80. The sheet ejection part 80 is configured of a carrying guide 81 that guides the sheet P upward along the carrying route W, carrying roller pairs 82, 83, 84, and 85 opposing with each other through the carrying route W, etc.

Also, disposed in the lower side of the switching part 75, the fuser part 70, the secondary transfer part 49, etc. is a recarrying part 90. The recarrying part 90 has a carrying guide, a carrying roller pair (not shown), etc. that constitute a recarrying route Z. The recarrying route Z runs downward from the lower side of the switching part 75, in due course proceeds forward, and afterwards merges into the carrying route W in the downstream side of the carrying roller pair 57.

When ejecting the sheet P, the controller 3 switches the procession direction of the sheet P by the switching part 75 to the sheet ejection part 80 side in the upper side. The sheet ejection part 80 carries upward the sheet P received from the switching part 75, and ejects it through an ejection port 86 to the sheet ejection tray 2T. Also, when returning the sheet P, the controller 3 switches the processing direction of the sheet P by the switching part 75 to the recarrying part 90 side in the lower side. The recarrying part 90 carries the sheet P received from the switching part 75 to the recarrying route Z, and in due course has the sheet P reach the downstream side of the carrying roller pair 57 to be carried again along the carrying route W. Thereby, in the image forming apparatus 1, the sheet P is returned to the carrying route W in a state where the sheet P faces are reversed, allowing so-called double-side printing.

In this manner, in the image forming apparatus 1, in the image forming units 10 toner images are formed using the toners T and transferred to the intermediate transfer belt 44, and in the secondary transfer part 49 the toner images are transferred from the intermediate transfer belt 44 to the sheet P, and further fused in the fuser part 70, allowing an image to be printed on the sheet P, that is, forming an image.

Figure 4:
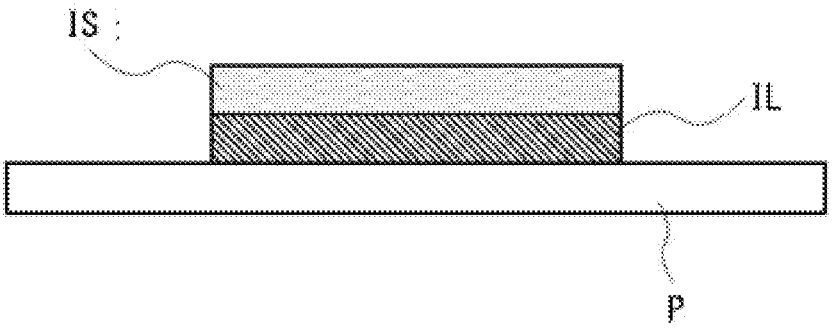
FIG. 4 is a schematic diagram showing the transfer of a brilliance superimposed toner image to a sheet.

For example, in the image forming apparatus 1, when a brilliant toner image IS with the brilliant toner TS and color toner images IL with the color toners TL are sequentially transferred to the intermediate transfer belt 44 in the image forming units 10, these toner images are transferred to the sheet P in the secondary transfer part 49. Thereby, as a schematic cross-sectional view is shown in FIG. 4, the color toner images IL adhere to the surface of the sheet P, and further the brilliant toner image IS is superimposed.

Hereafter, a print process that superimposes the brilliant toner image IS over the color toner image IL is called a brilliance superimposing print process, and a toner image where the brilliant toner image IS is superimposed over the color toner image IL is also called a brilliance superimposed toner image. Also hereafter, a color toner image formed with the black toner TK is also called a black toner image, and a color toner image formed with the yellow toner TY is also called a yellow toner image. Further hereafter, a color toner image formed with the magenta toner TM is also called a magenta toner image, and a color toner image formed with the cyan toner TC is also called a cyan toner image.

Incidentally, in the image forming apparatus 1, by increasing the absolute values of bias voltages applied to the individual parts by the control of the controller 3, the deposition amounts of the toners T in the toner image transferred to the sheet P (hereafter called on-medium deposition amounts, whose details are mentioned below) can be increased, and by decreasing the absolute values of the bias voltages, the on-medium deposition amounts can be decreased.

For one embodiment, the absolute values of bias voltages may be changed by from 5% to 20%, which are applied to the first and second supply rollers, the development roller, the development blade and the charging roller. The deposition amounts of tonners are controlled in correspondence with these changes. All the bias voltages to the rollers may be changed evenly, but one bias voltage to one roller may be changed differently from other rollers. Further, among the rollers, only one or more selected rollers may be targets of which the bias voltages are changed.

Here is one example. When bias voltages to the development roller and the supply rollers simultaneously increase or decrease by 30V, the deposition amount of color toner on a medium either increases or decreases by 0.1 mg/cm$^2$. In a case where the bias voltage of the development roller was −200V, and the bias voltage of the supply roller(s) was −400V, and the deposition amount of tonner was 0.40 mg/cm$^2$, increasing the bias voltage to the development roller to −230V and the bias voltage to the supply roller(s) to −430V with respect to their absolute values, the deposition amount of color toner on the medium became 0.50 mg/cm$^2$. On the other hand, decreasing the bias voltage to the development roller to −170V and the bias voltage to the supply roller(s) to −370V, the deposition amount of color toner on the medium became 0.30 mg/cm$^2$.

2. Manufacturing of Brilliant Toner

Next, explained is manufacturing of the silver toner T, that is the brilliant toner TS, among the toners T accommodated in the toner container 12 of the image forming unit 10 (FIG. 2). In this embodiment, by making manufacturing conditions etc. different as appropriate, plural kinds of the brilliant toners TS having different constitutions and characteristics were manufactured. Hereafter, the brilliant toners TS manufactured by Embodiment 1, Comparative Example 1, Embodiment 2, Embodiment 3, Embodiment 4, Embodiment 5, and Comparative Example 2 are called brilliant toners TSa, TSb, TSc, TSd, TSe, TSf, and TSg, respectively.

In general, contained in the toner T are, other than a pigment for developing a desired color, a binding resin for binding this pigment with a medium such as the sheet P, an external additive for improving chargeability, etc. The brilliant toner TS used in this embodiment uses aluminum (Al) as a pigment having brilliance (this is hereafter also called a brilliant pigment), where aluminum pieces are contained in toner base particles that are the base of the toner.

2-1. Embodiment 1

In this Embodiment 1, generated was an aqueous medium where an inorganic dispersant was dispersed. Specifically, industrial trisodium phosphate dodecahydrate 919 pts. wt. were added to pure water 26526 pts. wt., dissolved at liquid temperature 60 [° C.], and afterwards dilute nitric acid was added for adjusting pH (hydrogen-ion exponent). Added to this solution was a calcium chloride solution where industrial anhydrous calcium chloride 443 pts. wt. were dissolved in pure water 4504 pts. wt., and keeping its liquid temperature at 60 [° C.], it was high-speed stirred for 34 minutes by a line mill (manufactured by PRIMIX Corporation) at a rotation speed of 3566 [rpm]. Thereby, prepared was a water phase that was an aqueous medium where a suspension stabilizer (inorganic dispersant) was dispersed.

Next, in Embodiment 1, a pigment-dispersed liquid was generated. Specifically, mixed with ethyl acetate 7427 pts. wt. were a brilliant pigment 394 pts. wt. and a charge control agent (BONTRON E-84 manufactured by Orient Chemical Industries Co., Ltd.) 59 pts. wt. Among these, the brilliant pigment contains tiny thin pieces, that is, small pieces of aluminum (Al) formed in a platy, flat, or scaly shape. The small aluminum pieces contained in this brilliant pigment were 0.5 [μm] in average thickness, 8 [μm] in average short side length, and 12 [μm] in average long side length. Hereafter, this brilliant pigment is also called an aluminum pigment, a metallic pigment, or a silver toner pigment.

Also, because of the reasons mentioned below, this brilliant pigment was given an average particle size of 5 [μm] or larger and 20 [μm] or smaller. That is, it is known that if the average particle size of a brilliant pigment is 5 [μm] or smaller, toner brilliance decreases, and thus image brilliance also decreases, degrading the image quality. On the other hand, it is known that if the average particle size of a brilliant pigment is larger than 20 [μm], the brilliant pigment cannot be contained in the toner base particles, making it difficult to form a toner, and even if a toner could be formed, it becomes difficult to carry the toner inside the image forming apparatus 1, thereby making image formation practically impossible.

Note that the average particle size of the brilliant pigment was measured using a digital microscope (VH-5500 manufactured by Keyence Corporation) and a lens (VH-500 manufactured by Keyence Corporation). In this average particle size measurement, the brilliant toner was dispersed in a surfactant (EMULGEN 109P manufactured by Kao Corporation), dropped onto a slide glass, over which a cover glass was placed, and was observed at a magnification of 1000 times with transmitted illumination. In this measurement, utilizing the fact that the brilliant pigment appears black by blocking light, longitudinal-direction particle sizes of 50 pieces of the brilliant pigment contained in the brilliant toner were measured, and the average value was regarded as the average particle size.

Afterwards, in Embodiment 1, the pigment-dispersed liquid was stirred while maintaining its liquid temperature at 50 [° C.], a charge control resin (FCA-726N manufactured by Fujikura Kasei Co., Ltd.) 38 pts. wt., ester wax (WE-4 manufactured by NOF Corporation) 148 pts. wt. as a release agent, and polyester resin 131 pts. wt. as a binder resin were added, and stirred until solid matter disappears. Thereby, an oil phase that is a pigment-dispersed oil-based medium was prepared.

Next, in Embodiment 1, the oil phase was added to the water phase maintained at 60 [° C.] in liquid temperature, which was suspended by stirring for 5 minutes at a rotation speed of 900 [rpm], forming particles in the suspension. Afterwards, ethyl acetate was removed by reduced-pressure distillation, forming a slurry containing a toner. Next, nitric acid was added to this slurry to make pH (hydrogen-ion exponent) 1.6 or lower, which was stirred, tricalcium phosphate that is a suspension stabilizer was dissolved, and through dehydrating it, the toner was extracted.

Further, in Embodiment 1, the extracted toner was redispersed in pure water, which was stirred, water-washing was performed, and afterwards a dehydration process, a drying process, and a classification process were sequentially performed, thereby generating toner base particles.

In Embodiment 1, an external addition process was performed to the toner base particles generated in this manner. Specifically, small silica (RY 200 manufactured by Nippon AEROSIL Co., Ltd.) 1.5 [wt. %], colloidal silica (X24-9163A manufactured by Shin-Etsu Chemical Co., Ltd.) 2.29 [wt. %], and melanin particles (EPOSTAR S manufactured by Nippon Shokubai Co., Ltd.) 0.37 [wt. %] were injected and mixed. Thereby, the brilliant toner TSa was obtained in Embodiment 1.

2-2. Comparative Example 1

In Comparative Example 1, although generally the same procedures as in Embodiment 1 were followed, by changing the brilliant pigment quantity to 90 pts. wt., the brilliant toner TSb was prepared.

2-3. Embodiment 2

In Embodiment 2, although generally the same procedures as in Embodiment 1 were followed, by changing the brilliant pigment quantity to 173 pts. wt., the brilliant toner TSc was prepared

2-4. Embodiment 3

In Embodiment 3, although generally the same procedures as in Embodiment 1 were followed, by changing the brilliant pigment quantity to 251 pts. wt., the brilliant toner TSd was prepared

2-5. Embodiment 4

In Embodiment 4, although generally the same procedures as in Embodiment 1 were followed, by changing the brilliant pigment quantity to 430 pts. wt., the brilliant toner TSe was prepared

2-6. Embodiment 5

In Embodiment 5, although generally the same procedures as in Embodiment 1 were followed, by changing the brilliant pigment quantity to 441 pts. wt., the brilliant toner TSf was prepared

2-7. Comparative Example 2

In Comparative Example 2, although generally the same procedures as in Embodiment 1 were followed, by changing the brilliant pigment quantity to 501 pts. wt., the brilliant toner TSg was prepared.

3. Manufacturing of Color Toners

Next, explained is a process of manufacturing the color toner TL in yellow color, that is the yellow toner TY, among the toners T accommodated in the toner containers 12 of the image forming units 10 (FIG. 2). Note that although explained below is the manufacturing process using an emulsion polymerization method as an example, this invention is not limited to this.

In this process, prepared in advance are a styrene-acrylic copolymer resin as a binding resin and a coloring agent, and further wax, an external additive, and a charge control agent. Note that the wax, the external additive, and the charge control agent can be omitted. Among these, styrene-acrylic copolymer resin can be manufactured from styrene, acrylic acid, and methylmethacrylic acid. The coloring agent is a mixture of yellow pigments C. I. (Color Index International) Pigment Yellow 155 and C. I. Pigment Yellow 185 at 4:1 ratio.

The wax is paraffin wax for example. The external additive is silica, containing a hydrophobic small silica fine powder of 8-20 [nm] in average particle size, a hydrophobic large silica fine powder of 2080 [nm] in average particle size, and a colloidal silica fine powder of 80~140 [nm] in average particle size for example. Among these, the hydrophobic small silica fine powder is "AEROSIL® R 972" or "AEROSIL® R 974" manufactured by Nippon Aerosil Co., Ltd. for example. Also, the hydrophobic large silica fine powder is "AEROSIL® RX 50" or "AEROSIL® VP RX40S" manufactured by Nippon Aerosil Co., Ltd. for example. The colloidal silica fine powder is sol-gel silica spherical particles "X-24-9163A" or "X-24-9600A-80" manufactured by Shin-Etsu Chemical Co., Ltd. For example.

Next, in this process, the styrene-acrylic copolymer resin, the coloring agent, the wax, and the charge control agent are mixed using the emulsion polymerization method, thereby generating colored resin particles through agglomeration. Note that the wax and the charge control agent can be omitted. In this emulsion polymerization method, a resin monomer is dispersed in a solvent containing a emulsifier, a polymerization initiator, and water to create primary particles, and the coloring agent emulsified by a emulsifier (surfactant) is mixed into the solvent containing these primary particles. Subsequently in this emulsion polymerization method, the wax, the charge control agent, etc. are added and mixed into this solvent, and their agglomeration generates colored resin particles in the solvent. Further in this process, the colored resin particles are extracted from the solvent and washed and dried, thereby removing unnecessary solvent ingredients and by-product components, obtaining the colored resin particles.

Next, in this process, silica as an external additive can be added to the colored resin particles and mixed by a mixer, thereby manufacturing a nonmagnetic single-component toner (that is, the yellow toner TY). As this mixture, a Henschel mixer manufactured by Mitsui Mining Co., Ltd. can be used.

Further, in this embodiment, by performing the individual procedures by changing only the pigment in this process, the black toner TK, the magenta toner TM, and the cyan toner TC can be manufactured.

4. Toner Measurements and Evaluations

Next, various characteristics of the toners T themselves or the toners T fused as an image on the sheet P (that is, a toner image) were measured and also evaluated. Measured here were the aluminum contents of the brilliant toners TS (that is, the brilliant toners TSa, TSb, TSc, TSd, TSe, TSf, and TSg) and their brilliance when printed as an image (that is, toner image) on the sheet P. Also, evaluated was metallic color expressibility when the brilliant toner TS and the color toners TL were superimposed and printed on the sheet P using the image forming apparatus 1 (FIG. 1).

[4-1. Aluminum Content Measurements]

In this measurements, the aluminum contents of the brilliant toners TS (TSa~TSg) prepared by the above-mentioned methods were measured.

In general, the amount of a pigment contained in the toner T is often defined by the charge amount (added amount) of the pigment in the manufacturing stage of the toner T. However, even if the pigment is charged in the toner T manufacturing stage, not all the charged pigment is taken into the toner, but there is some pigment not recovered in the classification process. Therefore, it is not appropriate to define the amount of pigment contained in the toner T by its charge amount.

Also, the pigment ratio relative to the pigment-dispersed liquid prepared by mixing ethyl acetate, the brilliant pigment, and the charge control agent is different from the pigment ratio relative to the toner base particles. Therefore, it is difficult to define the amount of pigment contained in the toner T by its charge amount.

Then, using an energy dispersive fluorescent X-ray analyzer (EDX-800HS manufactured by Shimazu Corporation), the amounts of aluminum element (Al) contained in the brilliant toners TSa~TSg prepared by the above-mentioned procedures, that is, their aluminum contents, were measured.

In general, when X-ray is radiated to a sample, fluorescent X-ray that is the characteristic X-ray of atoms contained in the sample is generated and emitted from the sample. Because this fluorescent X-ray has characteristic wavelengths (energies) of individual elements, a qualitative analysis can be performed by examining the wavelengths of fluorescent X-ray. Also, the intensity of fluorescent X-ray becomes a function of the density. Therefore, a quantitative analysis can be performed by measuring the amount of X-ray by the characteristic wavelengths of individual elements.

In this measurement, based on such a principle, the brilliant toners TS (TSa~TSg) were irradiated with X-ray emitted from an X-ray tube using the energy dispersive fluorescent X-ray analyzer. Then, in this measurement, based on fluorescent X-ray emitted from aluminum (Al) atoms contained in the brilliant toners TS, the aluminum contents of the brilliant toners TS were measured. Note that the usage conditions of the energy dispersive fluorescent X-ray analyzer were set as follows.

Atmosphere: Helium replacement measurements

X-ray irradiation condition: Voltage 15 [kV], Current 100 [μA]

Figures 5, 6:
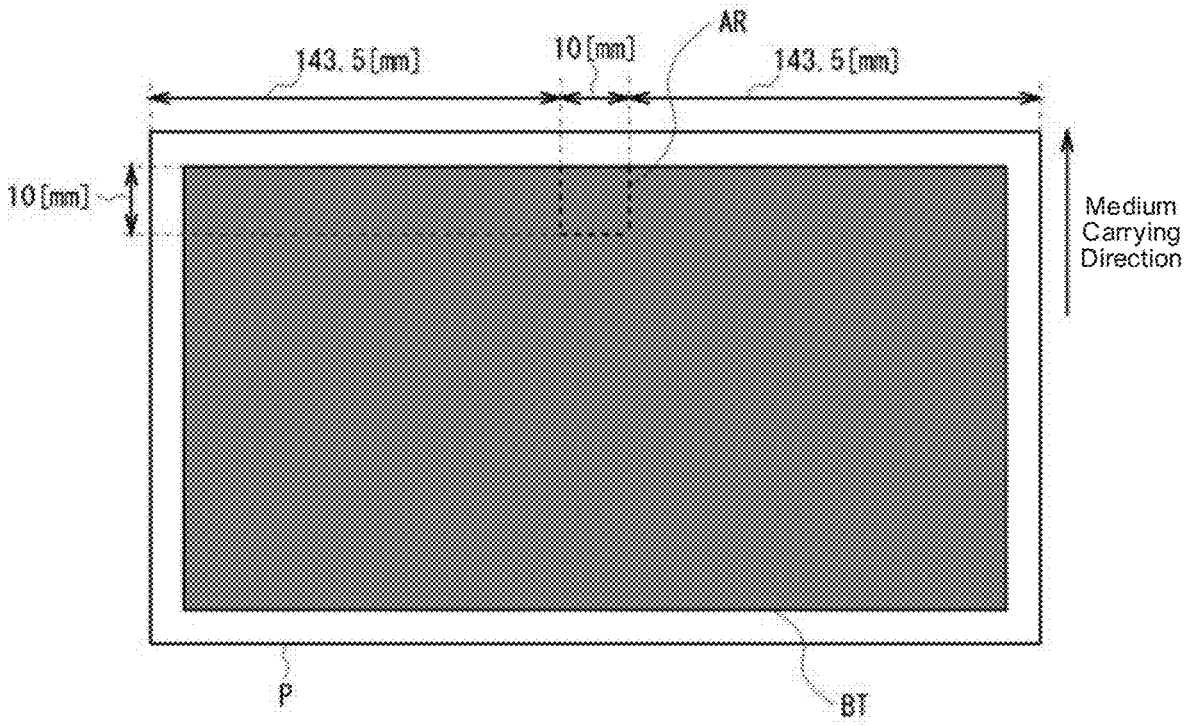
FIG. 5 is a table listing aluminum content measurement results and brilliance judgement results.
FIG. 6 is a schematic diagram showing the toner measurement area on a solid image pattern.

By this measurement, as the aluminum contents of the brilliant toners TS, measurements results shown in FIG. 5 were obtained. In this FIG. 5, each aluminum content is expressed in volume percentage of aluminum relative to each brilliant toner TS.

[4-2. Brilliance Evaluation]

In this evaluation, after accommodating the brilliant toner TS (one of the brilliant toners TSa~TSg) in the toner container 12 (FIG. 2) of the image forming unit 10S corresponding to the special color in the image forming apparatus 1 (FIG. 1), a print process was performed, and each brilliance evaluation was performed.

Specifically, in this evaluation, using coated paper (OS coated paper W, weight 127 [g/m$^2$] manufactured by Fuji Xerox Co., Ltd.) as the sheet P, an image pattern where the print image density of the brilliant toner TS was set to 100[%] (so-called a solid image) was printed by the image forming apparatus 1. In this case, in the image forming apparatus 1, by performing a prescribed operation for setting print conditions, the print process was performed in a state where the deposition amount of the brilliant toner TS on the photosensitive drum 36 of the image forming unit 10S (FIG. 2) becomes 1.0 [mg/cm$^2$].

Here, the deposition amount of the toner T on a medium such as the sheet P is expressed in weight [mg] per unit area of 1 [cm$^2$], and its unit becomes [mg/cm$^2$]. This is hereafter called an on-medium deposition amount. This on-medium deposition amount is measured and calculated by the following method.

First, a jig made of metal having a flat part is prepared, and a both-side tape is pasted on a portion having a 1 [cm$^2$] area of the flat part of this jig. In this state, the weight of this jig is measured with an electronic balance (Sartorius CPA225D), and afterwards a direct current voltage of +300 [V] is applied to this jig using an external power supply.

Next, as shown in FIG. 6, prepared is a medium (that is, the sheet P) to which transferred is an image pattern where the print image density is set to 100[%] (that is, a toner image, hereafter called a solid image pattern BT). The toner T on this medium is sampled by pressing the jig once on a 10 [mm] square area (hereafter called a measurement area AR) that is approximately the center relative to the main scanning direction and near the head relative to the medium carrying direction (that is, the sub scanning direction). Incidentally, the sheet P has a length of 297 [mm] in the main scanning direction (the right-left direction in the figure) that is equivalent to the long side in A4 size or the short side in A3 size. Subsequently, the weight of the jig with the toner T adhering is measured again with the electronic balance. Afterwards, by calculating the weight increase of the jig before and after toner sampling, the on-medium deposition amount [mg/cm$^2$] is calculated.

Here, the print image density is a value expressing the ratio of the number of pixels that transfer the toner T to the sheet P to the number of all the pixels when an image is divided into pixels. For example, the area ratio 100% printing when performing solid printing over the entire printable range of a prescribed area (one round of the photosensitive drum or one page of the print medium) is defined to have a print image density of 100[%], and printing corresponding to a 1[%] area relative to this print image density of 100[%] is defined to have a print image density of 1[%]. If the print image density DPD is expressed in a formula using a used dot number Cm, a rotation number Cd, and a total dot number CO, it can be expressed as the following Eq. (3).

$$DPD=Cm/(Cd\times CO)\times 100[\%] \quad (3)$$

Note that the used dot number Cm is the number of dots used for actually forming an image while the photosensitive drum 36 makes Cd rotations, that is the total number of dots exposed by the LED head 14 (FIG. 2) while the image is being formed. Also, the total dot number CO is the total number of dots per one rotation of the photosensitive drum 36 (FIG. 2), that is, regardless of the absence/presence of exposure, the total number of dots potentially usable in forming an image by the photosensitive drum 36 during one rotation. In other words, the total dot number CO is the total number of dots used in forming a solid image where the toner T is transferred to all the pixels. Therefore, the value (Cd×CO) expresses the total number of dots potentially usable in forming an image while the photosensitive drum 36 makes Cd rotations.

In this embodiment, weight per unit area in a toner image that was formed in the image forming unit 10 of the image forming apparatus 1 (FIG. 1) and was transferred to a medium (that is, the sheet P) in the secondary transfer part 49 is defined as an on-medium deposition amount [mg/cm$^2$].

Figures 7, 8:
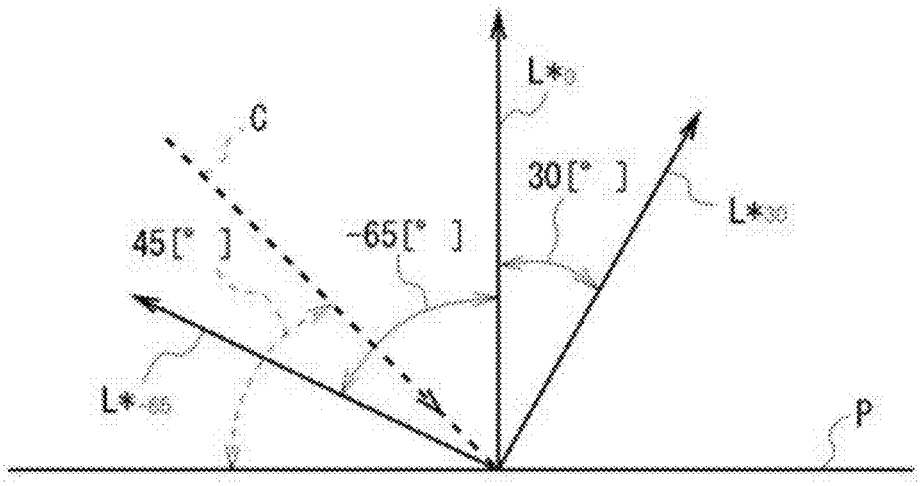
FIG. 7 is a schematic diagram showing light irradiation and reception by a variable-angle photometer.
FIG. 8 is a table listing blurring evaluation results.

Next, in this evaluation, brilliance was measured using a variable-angle photometer (GC-5000L manufactured by Nippon Denshoku Industries Co., Ltd.). Specifically, as shown in FIG. 7, using the variable-angle photometer, the sheet P was irradiated by radiating a light beam C from a 45 [°] direction relative to the surface of the sheet P, reflected light was received in 0 [°], 30 [°], and −65 [°] directions relative to the vertical direction, and based on the obtained light reception results, lightness indices $L^*_0$, $L^*_{30}$, and $L^*_{-65}$ were calculated, respectively. Next, in this evaluation, by substituting the calculated lightness indices in the following Eq. (4), a flop index FI was calculated, measuring brilliance of the image.

$$FI=2.69\times(L^*_{30}-L^*_{-65})^{1.11}/(L^*_0)^{0.86} \quad (4)$$

This flop index FI indicates high brilliance if the value is large, and low brilliance if the value is small. In this evaluation, if the flop index FI is 14 or higher, because the printed matter generates metallic luster, brilliance of the image was evaluated as high, and if the flop index FI is lower than 14, because the printed matter does not generate metallic luster, the brilliance was evaluated as low.

Then, in this evaluation, the aluminum contents of the brilliant toners TS used for the evaluation and the evaluation results are listed in FIG. 5. As the evaluation results, a code "○" was written in the case of a high evaluation where the flop index FI was 14 or higher, and a code "x" was written in the case of a low evaluation where the flop index FI was lower than 14. From this FIG. 5, in this evaluation, it can be said that if the aluminum content is 6.7[%] or higher and 17.2[%] or lower, brilliance of the image pattern is relatively high, and the image quality is good.

In an image using the brilliant toner TS, if the aluminum content is too low, specifically lower than 6.7[%], because it signifies that the content of a pigment having brilliance is low, brilliance of the image decreases. Also, in an image using the brilliant toner TS, if the aluminum content is too high, specifically higher than 17.2[%], the pigment arrangement on the sheet P worsens, increasing the number of brilliant pigment particles whose faces are not in parallel to the paper face of the sheet P. Because of such reasons, the aluminum content should desirably be 6.7[%] or higher and 17.2[%] or lower in the brilliant toner TS.

For other materials for the brilliant toner of the invention, any metallic materials, such as gold, silver, platinum, iron and iron oxide, are available for main ingredients. These materials can be used for an additional material as well. Also, colored aluminum may be available for color metallic pigments. Mica is available for pearl pigments.

[4-3. Blurring Evaluation]

In this evaluation, after accommodating the toner T in the toner container 12 (FIG. 2) of the image forming unit 10 in the image forming apparatus 1 (FIG. 1), a print process was performed, and a blurring evaluation was performed. Here, blurring signifies that when an image is formed on the sheet P, the toner T is not fused on a spot to which the toner T should be transferred.

Specifically, in this evaluation, a plurality of pieces of printed matter were prepared using the brilliant toners TS (TSa~TSg) by the image forming apparatus 1 while changing the on-medium deposition amount (this is hereafter also called a brilliant deposition amount MS) of an image pattern whose print image density is set to 100[%] (that is, the solid image pattern BT) to a plurality of values. The on-medium deposition amount was changed to six values within a range of 0.01~0.06 [mg/cm$^2$] with 0.01 [mg/cm$^2$] intervals.

In addition, in this evaluation, a plurality of pieces of printed matter were prepared also using the color toners TL (the black toner TK, the yellow toner TY, the magenta toner TM, and the cyan toner TC) by the image forming apparatus 1 while changing the on-medium deposition amount (this is hereafter also called a color deposition amount ML) of the solid image pattern BT to a plurality of values. The on-medium deposition amount was changed to six values within a range of 0.01~0.06 [mg/cm$^2$] with 0.01 [mg/cm$^2$] intervals.

Then, in this evaluation, by visually checking the image of each of the prepared printed matter, the presence/absence of blurring was individually evaluated. Specifically, visually judged in this evaluation was the occurrences of longitudinal stripes parallel to the procession direction (that is, the carrying direction) of the sheet P, and part whose density varies at the same cycle with the outer circumferential length of the first supply roller 32 and the second supply roller 33 (FIG. 2), that is, a lateral stripe pattern.

In this evaluation, if blurring occurs in 1/10 or more of the print area, the code "x" was written as a low evaluation, and if blurring occurs in less than 1/10 of the print area, the code "○" was written as a high evaluation. Then, the evaluation results in this evaluation were summarized in correspondence with the kinds and the on-medium deposition amounts of the toner T in a table, obtaining FIG. 8.

It is evident from FIG. 8 that as to the brilliant toner TS, setting the on-medium deposition amount (that is, the brilliant deposition amount MS) to 0.03 [mg/cm$^2$] or higher can prevent blurring from occurring. It is also evident from FIG. 8 that as to the color toners TL (the black toner TK, the yellow toner TY, the magenta toner TM, and the cyan toner TC), setting the on-medium deposition amount (that is, the color deposition amount ML) to 0.04 [mg/cm$^2$] or higher can prevent blurring from occurring.

When an initial brilliant deposition amount MS is less than 0.03 [mg/cm$^2$], the blurring might occur. The controller adjusts the bias voltages that are applied to the development rollers and the supply roller(s) in order to set the brilliant deposition amount MS 0.03 [mg/cm$^2$], which is preferred to obtain a quality image. When an initial color deposition amount ML is less than 0.04 [mg/cm$^2$], the blurring might occur. The controller adjusts the bias voltages that are applied to the development rollers and the supply roller(s) in order to set the color deposition amount ML 0.04 [mg/cm$^2$], which is preferred to obtain a quality image.

[4-4. Metallic Color Expressibility Evaluation]

In this evaluation, evaluated were the degrees of color expression with the color toners TL and metallic luster expression with the brilliant toners TS (these are hereafter called metallic color expressibility) when brilliance superimposing print processes were performed (FIG. 4) by the image forming apparatus 1 (FIG. 1).

Below, after explaining the image density measurement of printed matter first, explained is a case of using the yellow toner TY as the color toner TL, and further explained are cases of using the black toner TK, the magenta toner TM, and the cyan toner TC.

[4-4-1. Printed Matter Image Density]

When printing an image on a medium such as the sheet P by the image forming apparatus 1 (FIG. 1), obtained is printed matter that is the sheet P to which toner images are transferred and fused, that is, printed. The image density on this printed matter is measured using a spectrodensitometer X-Rite 528 (manufactured by X-Rite Inc.) after setting the measurement conditions as follows and performing a calibration using a white calibration plate.

Measurement mode: Density measurement mode

Status: Status I

White reference: Absolute white reference

No polarizing filer

Among these "Status I" is setting the wavelength region for evaluation, and is defined in "ISO5-3 Photography and graphic technology—Density measurements—Part 3: Spectral conditions".

In this evaluation, when measuring the image density of printed matter, used as an "underlay" of the printed matter was a black paper medium (that is, black paper). Specifically, used as this black paper was one satisfying the following Eq. (5) where L*, a*, and b* values in the L*a*b* color system were denoted as L*(B), a*(B), and b*(B), respectively, specifically "colored wood-free paper black" (manufactured by Hokuetsu Kishu Paper Co., Ltd.).

$$25.1 \leq L^*(B) \leq 25.9 \text{ and}$$

$$0.2 \leq a^*(B) \leq 0.3 \text{ and}$$

$$0.5 \leq b^*(B) \leq 0.7 \quad (5)$$

In this evaluation, by setting the spectrodensitometer X-Rite 528 in this manner, obtained as the result of measuring the optical density (O. D.) are four values: a V (Visual) value, a Y (Yellow) value, an M (Magenta) value, and a C (Cyan) value.

In this embodiment, the optical density of printed matter obtained in this manner, that is, the V value, Y value, M value, or C value is defined as the image density of the printed matter. Specifically, in this evaluation, the V value among the optical densities was used as the image density of the toner image with the black toner TK, and the Y value among the optical densities was used as the image density of the toner image with the yellow toner TY. Also, in this evaluation, the M value among the optical densities was used as the image density of the toner image with the magenta toner TM, and the C value among the optical densities was used as the image density of the toner image with the cyan toner TC.

[4-4-2. Metallic Color Expressibility when Using Yellow Toner]

In this evaluation, when the image density of the yellow toner TY was measured by the above-mentioned method as an advance preparation, it was found that when the weight of the yellow toner TY on the sheet was 0.40 [mg/cm$^2$] or higher and 0.50 [mg/cm$^2$] or lower, the print density OD value was 1.40.

Here, the image density evaluations for the on-medium deposition amounts were performed through the following procedures.

<1> The image forming apparatus 1 with the image forming units 10 mounted (FIGS. 1 and 2) and a medium (that is, the sheet P) are left alone for 24 hours under an environment of temperature 22 [° C.] and humidity 55[%].

<2> The fuser part 70 (FIG. 1) of the image forming apparatus 1 is warmed up, heating the heat application belt of the heat application part 71 to 155±5 [° C.] and the pressure application roller of the pressure application part 72 to 135±5 [° C.].

<3> A print process is performed by the image forming apparatus 1 to print one piece of the solid image pattern BT (FIG. 6) that is an image pattern having a print image density of 100[%]. In this evaluation, using the brilliant toner TSa and the yellow toner TY, as shown in FIG. 4, the color toner image IL and the brilliant toner image IS are printed so as to be sequentially superimposed on the sheet P.

<4> In the image forming apparatus 1, a print process is started with the same print conditions as in Procedure <3>, and before the measurement area AR (FIG. 6) of the sheet P reaches the fuser part 70 (FIG. 1), the print process is stopped.

<5> The image density of the measurement area AR on the printed matter (that is, the sheet P after printing) obtained by Procedure <3> is measured.

<6> The on-medium deposition amount in the measurement area AR on the sheet P obtained by Procedure <4>, that is, the sheet P to which the toner image of the solid image pattern BT is transferred and is not fused yet, is measured by the above-mentioned method.

In this evaluation, by changing the on-medium deposition amount of the brilliant toner TSa (this is hereafter called a brilliant deposition amount MS) and the on-medium deposition amount of the yellow toner TY (this is hereafter called a yellow deposition amount MY) into 5 levels (that is, 5 stages of quantity) each, a total of 25 combinations of print conditions were used in preparing printed matter. Then, in this evaluation, metallic color expressibility, that is color reproducibility and luster expressibility, of the image of each printed matter was visually judged according to the following evaluation criteria.

In this evaluation, if brilliance is expressed with the brilliant toner TSa, and color vividness is also expressed with the yellow toner TY, it was judged that metallic color was appropriately expressed, and the image quality was good. On the other hand, in this evaluation, if at least one of brilliance with the brilliant toner TSa and color vividness with the yellow toner TY is lost, it was judged that metallic color was not sufficiently expressed, and the image quality was bad.

Also, in this evaluation, for the image of each printed matter, when the image quality was especially good, a code "◎" was written as a high evaluation, when the image quality was sufficiently good, the code "○" was written as a medium evaluation, and when the image quality was poor, the code "x" was written as a low evaluation.

Then, the results of evaluating metallic color expressibility in this evaluation were summarized in a table in correspondence with the brilliant deposition amounts MS and the yellow deposition amounts MY of the printed matter, obtaining FIG. 9. Note that when the brilliant deposition amount MS was lower than 0.03 [mg/cm$^2$], because blurring occurs as shown in FIG. 8, no good image quality was obtained in the printed matter.

Also, listed in FIG. 9 are values of the on-medium deposition amount of the toner T on the sheet P, specifically the sum of the brilliant deposition amount MS and the yellow deposition amount MY as a total deposition amount U in each combination. Further listed in FIG. 9 are values of the ratio of the yellow deposition amount MY to the brilliant deposition amount MS, specifically the yellow deposition amount MY divided by the brilliant deposition amount MS, as a deposition amount ratio R in each combination.

Figures 10, 11:
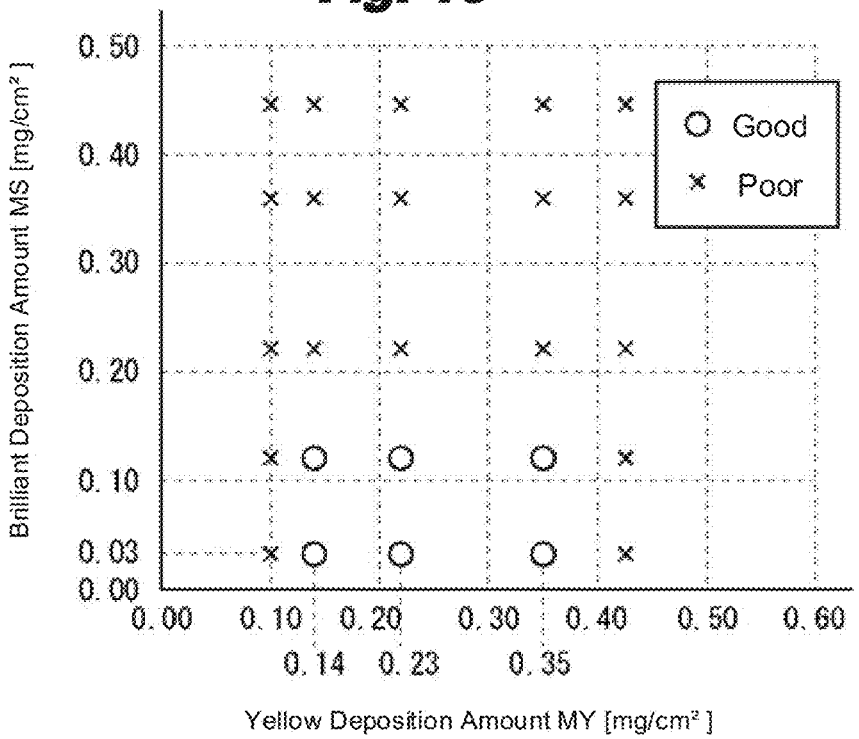
FIG. 10 is a plot showing the distribution of metallic color expressibility evaluations according to on-medium deposition amounts when using the yellow toner.
FIG. 11 is a table listing metallic color expressibility evaluations when using the yellow toner and restricting the deposition amount ratio.

Further in this evaluation, the codes indicating the evaluation results in the individual combinations were plotted with the yellow deposition amount MY as the horizontal axis and the brilliant deposition amount MS as the vertical axis, obtaining a distribution characteristic as shown in FIG. 10. Note that in FIG. 10 both the high evaluation and the medium evaluation were judged as good and plotted as the code "0".

Referring to FIG. 9, it is evident that when the brilliant deposition amount MS was 0.03 [mg/cm$^2$] or higher and 0.12 [mg/cm$^2$] or lower, and the yellow deposition amount MY was 0.14 [mg/cm$^2$] or higher and 0.35 [mg/cm$^2$] or lower, metallic color expressibility was evaluated as medium or higher, and the image quality of the printed matter was good. It is also evident that combinations receiving high or medium evaluation in metallic color expressibility are in a region approximately drawing a rectangle in the distribution characteristic of FIG. 10.

It is further evident in FIG. 9 that especially in 3 combinations among them, specifically when the brilliant deposition amount MS was set to 0.12 [mg/cm$^2$], and the yellow deposition amount MY was set to 0.14, 0.23 or 0.35 [mg/cm$^2$], metallic color expressibility was evaluated as high. In these 3 combinations, the deposition amount ratio R has a lower limit of 1.17 and a higher limit of 2.92.

Then, in this evaluation, the total deposition amount U was evaluated by restricting the deposition amount ratio R value based on the 3 combinations having good metallic color expressibility. Specifically, in this evaluation, 12 kinds of printed matter were prepared by fixing the deposition amount ratio R to 1.17 or 2.92, and changing the brilliant deposition amount MS and the yellow deposition amount MY, accompanied by various changes in the total deposition amount U. In addition, in this evaluation, individual pieces of printed matter were also prepared in cases where the deposition amount ratio R was intentionally set outside the range of 1.17 or higher and 2.92 or lower, specifically cases where the deposition amount ratio R was set to 1.00 and 3.09.

In this evaluation, for the images of the total 14 kinds of printed matter prepared in this manner, metallic color expressibility was evaluated in the same manner as in the case mentioned above, and the results were summarized in a table similar to FIG. 9, obtaining FIG. 11. In this FIG. 11, in the same manner as in the case of FIG. 9, when the image quality was especially good, the code "◎" was written as a high evaluation, when the image quality was sufficiently good, the code "○" was written as a medium evaluation, and when the image quality was bad, the code "x" was written as a low evaluation.

Referring to FIG. 11, it is evident that when the deposition amount ratio R (=the yellow deposition amount MY/the brilliant deposition amount MS) was 1.17 or higher and 2.92 or lower, and the total deposition amount U (=the brilliant deposition amount MS+the yellow deposition amount MY) was 0.07 [mg/cm$^2$] or higher and 0.47 [mg/cm$^2$] or lower, metallic color expressibility was evaluated as high.

On the other hand, in FIG. 11, when the total deposition amount U was higher than 0.47 [mg/cm$^2$], metallic color expressibility was evaluated as low. This is believed to be caused by the fact that having relatively a large amount of the toner T made the toner difficult to melt in the fuser part 70, therefore surface smoothness in the fused image worsened, degrading glossiness (or shininess).

In general, the flop index becomes higher as the difference between the amount of light near the reflection angle and the amount of light near the receding angle becomes larger. Therefore, a decrease in glossiness that has a large contribution to the amount of light near the reflection angle leads to a decrease in the flop index. Because of this, for achieving good metallic color expressibility, the total deposition amount U on the sheet P needs to be suppressed to a certain value, specifically 0.47 [mg/cm$^2$] or lower. In other words, when expressing a metallic color by superimposing the brilliant toner TS and the yellow toner TY on the sheet P, the total deposition amount U that is the sum of their toner amounts needs to be suppressed lower than the toner amount when using only the yellow toner TY (that is, the yellow deposition amount MY).

Also, in FIG. 11, when the deposition amount ratio R is lower than 1.17, metallic color expressibility is evaluated as low. It is speculated that because the amount of the yellow toner TY (that is, the color toner TL) was too low relative to the amount of the brilliant toner TS, color vividness could not be sufficiently expressed. Further, in FIG. 11, when the deposition amount ratio R is higher than 2.92, metallic color expressibility is evaluated as low. It is speculated that because the amount of the yellow toner TY (that is, the color toner TL) was too high relative to the amount of the brilliant toner TS, brilliance was insufficient.

Other than this, in this evaluation, cases of using the brilliant toners TSc, TSd, TSe, and TSf substituting for the brilliant toner TSa were evaluated in the same manner, obtaining the same evaluation results as in the case of using the brilliant toner TSa.

Thus, according to this evaluation, it has become evident that when using the yellow toner TY, if the deposition amount ratio R is 1.17 or higher and 2.92 or lower, and the total deposition amount U is 0.07 [mg/cm$^2$] or higher and 0.47 [mg/cm$^2$] or lower, a metallic color can be expressed well, and a good image quality can be obtained.

[4-4-3. Metallic Color Expressibility when Using Black Toner]

In this evaluation, evaluated was metallic color expressibility when using the black toner TK as the color toner TL. When the image density of the black toner TK was measured by the above-mentioned method as an advance preparation, if the weight of the black toner TK on the sheet was 0.40 [mg/cm$^2$] or higher and 0.50 [mg/cm$^2$] or lower, the print density OD (optical density) value was 1.40.

In this evaluation, in mostly the same manner as in the case of using the yellow toner TY, using the black toner TK, while changing the combination of the toner amounts in 25 different ways, respective pieces of printed matter were prepared through the above-mentioned procedures <1>~<6>. Note that in this case, values of the on-medium deposition amount of the black toner TK (this is hereafter called a black deposition amount MK) were set partially different from values of the yellow deposition amount MY. Also, in this evaluation, judgements on metallic color expressibility of the prepared pieces of printed matter were made according to the above-mentioned evaluation criteria.

Then, the results of evaluating metallic color expressibility in this evaluation are listed in a table in correspondence with the brilliant deposition amounts MS and the black deposition amounts MK of the printed matter, obtaining FIG. 12 that corresponds to FIG. 9. Listed in FIG. 12 are values of the on-medium deposition amount of the toner T on the sheet P, specifically the sum of the brilliant deposition amount MS and the black deposition amount MK as the total deposition amount U. Further listed in FIG. 12 are values of the ratio of the black deposition amount MK to the brilliant deposition amount MS, specifically the black deposition amount MK divided by the brilliant deposition amount MS, as the deposition amount ratio R in the individual combinations.

Figures 13, 14:
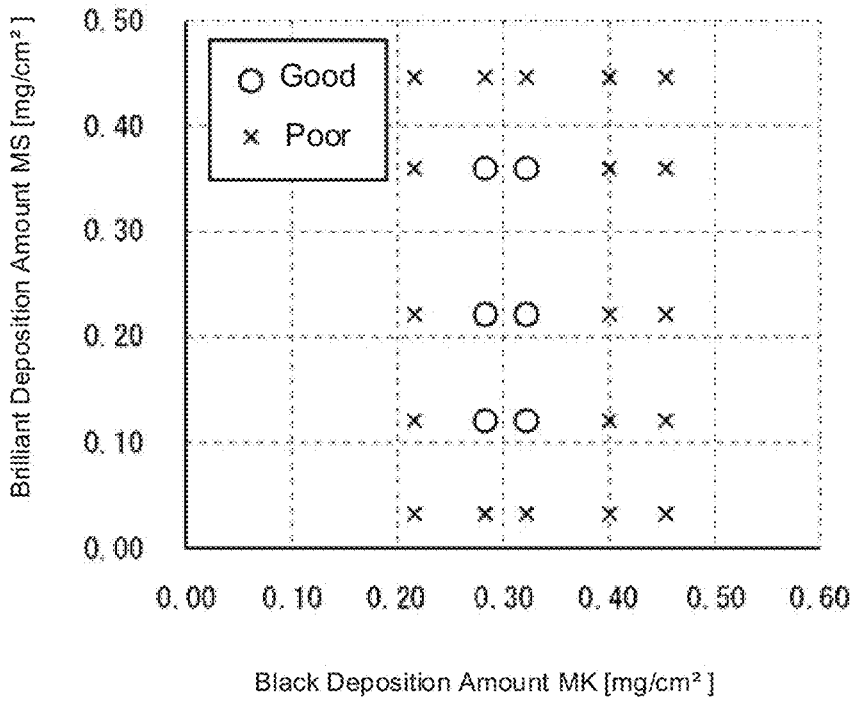
FIG. 13 is a plot showing the distribution of metallic color expressibility evaluations according to on-medium deposition amounts when using the black toner.
FIG. 14 is a table listing metallic color expressibility evaluations when using the black toner and restricting the deposition amount ratio.

Further in this evaluation, the codes indicating the evaluation results in the individual combinations were plotted with the black deposition amount MK as the horizontal axis and the brilliant deposition amount MS as the vertical axis, obtaining a distribution characteristic as shown in FIG. 13 that corresponds to FIG. 10.

Referring to FIG. 12, it is evident that when the brilliant deposition amount MS was 0.12 [mg/cm$^2$] or higher and 0.36 [mg/cm$^2$] or lower, and the black deposition amount MK was 0.28 [mg/cm$^2$] or higher and 0.33 [mg/cm$^2$] or lower, metallic color expressibility was evaluated as high, and the image quality of the printed matter was good. It is also evident that combinations receiving high evaluations in metallic color expressibility are in a region approximately drawing a rectangle in the distribution characteristic of FIG. 13.

It is further evident in FIG. 12 that when the brilliant deposition amount MS was set to 0.22 [mg/cm$^2$], metallic color expressibility was evaluated as high. The deposition amount ratio R in this case was 1.27 or 1.50. Then, in this evaluation, evaluations on the total deposition amount U were performed by restricting the deposition amount ratio R value based on the combinations evaluated as high in metallic color expressibility.

Specifically, in this evaluation, 12 kinds of printed matter were prepared by fixing the deposition amount ratio R value to 1.27 or 1.50, and changing the brilliant deposition amount MS and the black deposition amount MK, accompanied by various changes in the total deposition amount U. In addition, in this evaluation, individual pieces of printed matter were also prepared in cases where the deposition amount ratio R was intentionally set outside the range of 1.27 or higher and 1.50 or lower, specifically cases where the deposition amount ratio R was set to 1.22 and 1.71.

In this evaluation, for the images of the total 14 kinds of printed matter prepared in this manner, metallic color expressibility was evaluated in the same manner as in the case mentioned above, and the results were summarized in a table similar to FIG. 12, obtaining FIG. 14 that corresponds to FIG. 11. In this FIG. 14, in the same manner as in the case of FIG. 12, when the image quality was good (or better than others), the code "○" was written as a high evaluation, and when the image quality was bad, the code "x" was written as a low evaluation.

Referring to FIG. 14, it is evident that when the deposition amount ratio R (=the black deposition amount MK/the brilliant deposition amount MS) was 1.27 or higher and 1.50 or lower, and the total deposition amount U (=the brilliant deposition amount MS+the black deposition amount MK) was 0.07 [mg/cm$^2$] or higher and 0.69 [mg/cm$^2$] or lower, metallic color expressibility was evaluated as high.

According to this FIG. 14, when expressing a metallic color by superimposing the brilliant toner TS and the black toner TK on the sheet P, the total deposition amount U that is the sum of their toner amounts needs to be suppressed lower than the toner amount when using only the black toner TK (that is, the black deposition amount MK).

Other than this, in this evaluation, cases of using the brilliant toners TSc, TSd, TSe, and TSf substituting for the brilliant toner TSa were evaluated in the same manner, obtaining the same evaluation results as in the case of using the brilliant toner TSa.

Thus, according to this evaluation, it has become evident that when using the black toner TK, if the deposition amount ratio R is 1.27 or higher and 1.50 or lower, and the total deposition amount U is 0.07 [mg/cm$^2$] or higher and 0.69 [mg/cm$^2$] or lower, a metallic color can be expressed well, and a good image quality can be obtained.

[4-4-4. Metallic Color Expressibility when Using Magenta Toner]

In this evaluation, evaluated was metallic color expressibility when using the magenta toner TM as the color toner TL. When the image density of the magenta toner TM was measured by the above-mentioned method as an advance preparation, if the weight of the magenta toner TM on the sheet was 0.45 [mg/cm$^2$] or higher and 0.55 [mg/cm$^2$] or lower, the print density OD (optical density) value was 1.40.

In this evaluation, in mostly the same manner as in the case of using the yellow toner TY, using the magenta toner TM, while changing the combination of the toner amounts in 25 ways, respective pieces of printed matter were prepared through the above-mentioned procedures <1>~<6>. Note that in this case, values of the on-medium deposition amount of the magenta toner TM (this is hereafter called a magenta deposition amount MM) were set partially different from values of the yellow deposition amount MY. Also, in this evaluation, judgements on metallic color expressibility of the prepared printed matter were made according to the above-mentioned evaluation criteria.

Then, the results of evaluating metallic color expressibility in this evaluation are listed in a table in correspondence with the brilliant deposition amounts MS and the magenta deposition amounts MM of the printed matter, obtaining FIG. 15 that corresponds to FIG. 9. Listed in FIG. 15 are values of the on-medium deposition amount of the toner T on the sheet P, specifically the sum of the brilliant deposition amount MS and the magenta deposition amount MM as the total deposition amount U. Further listed in FIG. 15 are values of the ratio of the magenta deposition amount MM to the brilliant deposition amount MS, specifically the magenta deposition amount MM divided by the brilliant deposition amount MS, as the deposition amount ratio R in the individual combinations.

Figures 16, 17:
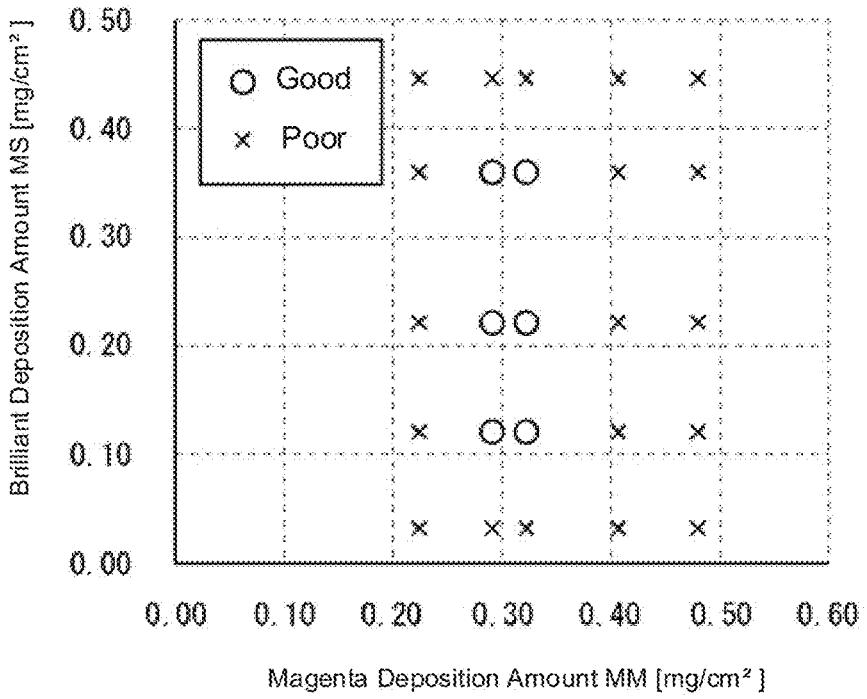
FIG. 16 is a plot showing the distribution of metallic color expressibility evaluations according to on-medium deposition amounts when using the magenta toner.
FIG. 17 is a table listing metallic color expressibility evaluations when using the magenta toner and restricting the deposition amount ratio.

Further in this evaluation, the codes indicating the evaluation results in the individual combinations were plotted with the magenta deposition amount MM as the horizontal axis and the brilliant deposition amount MS as the vertical axis, obtaining a distribution characteristic as shown in FIG. 16 that corresponds to FIG. 10.

Referring to FIG. 15, it is evident that when the brilliant deposition amount MS was 0.12 [mg/cm$^2$] or higher and 0.36 [mg/cm$^2$] or lower, and the magenta deposition amount MM was 0.29 [mg/cm$^2$] or higher and 0.33 [mg/cm$^2$] or lower, metallic color expressibility was evaluated as high, and the image quality of the printed matter was good. It is also evident that combinations evaluated as high in metallic color expressibility are in a region approximately drawing a rectangle in the distribution characteristic of FIG. 16.

It is further evident in FIG. 15 that when the brilliant deposition amount MS was set to 0.22 [mg/cm$^2$], metallic color expressibility was evaluated as high. The deposition amount ratio R in this case was 1.32 or 1.50. Then, in this evaluation, evaluations on the total deposition amount U were performed by restricting the deposition amount ratio R value based on the combinations evaluated as high in metallic color expressibility.

Specifically, in this evaluation, 12 kinds of printed matter were prepared by fixing the deposition amount ratio R to 1.32 or 1.50, and changing the brilliant deposition amount MS and the magenta deposition amount MM, accompanied by various changes in the total deposition amount U. In addition, in this evaluation, individual pieces of printed matter were also prepared in cases where the deposition amount ratio R was intentionally set outside the range of 1.32 or higher and 1.50 or lower, specifically cases where the deposition amount ratio R was set to 1.28 and 1.59.

In this evaluation, for the images of the total 14 kinds of printed matter prepared in this manner, metallic color expressibility was evaluated in the same manner as in the above-mentioned case, and the results were summarized in a table similar to FIG. 15, obtaining FIG. 17 that corresponds to FIG. 11. In this FIG. 17, in the same manner as in the case of FIG. 15, when the image quality was good, the code "○" was written as a high evaluation, and when the image quality was bad, the code "x" was written as a low evaluation.

Referring to FIG. 17, it is evident that when the deposition amount ratio R (=the magenta deposition amount MM/the brilliant deposition amount MS) was 1.32 or higher and 1.50 or lower, and the total deposition amount U (=the brilliant deposition amount MS+the magenta deposition amount MM) was 0.07 [mg/cm$^2$] or higher and 0.69 [mg/cm$^2$] or lower, metallic color expressibility was evaluated as high.

According to this FIG. 17, when expressing a metallic color by superimposing the brilliant toner TS and the magenta toner TM on the sheet P, the total deposition amount U that is the sum of their toner amounts needs to be suppressed lower than the toner amount when using only the magenta toner TM (that is, the magenta deposition amount MM).

Other than this, in this evaluation, cases of using the brilliant toners TSc, TSd, TSe, and TSf substituting for the brilliant toner TSa were evaluated in the same manner, obtaining the same evaluation results as in the case of using the brilliant toner TSa.

Thus, according to this evaluation, it has become evident that when using the magenta toner TM, if the deposition amount ratio R is 1.32 or higher and 1.50 or lower, and the total deposition amount U is 0.07 [mg/cm$^2$] or higher and 0.69 [mg/cm$^2$] or lower, a metallic color can be expressed well, and a good image quality can be obtained.

[4-4-5. Metallic Color Expressibility when Using Cyan Toner]

In this evaluation, evaluated was metallic color expressibility when using the cyan toner TC as the color toner TL. When the image density of the cyan toner TC was measured by the above-mentioned method as an advance preparation, if the weight of the cyan toner TC on the sheet was 0.40 [mg/cm$^2$] or higher and 0.50 [mg/cm$^2$] or lower, the print density OD (optical density) value was 1.40.

In this evaluation, in mostly the same manner as in the case of using the yellow toner TY, using the cyan toner TC, while changing the combination of the toner amounts in 25 ways, respective pieces of printed matter were prepared through the above-mentioned procedures <1>~<6>. Note that in this case, values of the on-medium deposition amount of the cyan toner TC (this is hereafter called a cyan deposition amount MC) were set partially different from values of the yellow deposition amount MY. Also, in this evaluation, judgements on metallic color expressibility of the prepared printed matter were made according to the above-mentioned evaluation criteria.

Then, the results of evaluating metallic color expressibility in this evaluation are listed in a table in correspondence with the brilliant deposition amounts MS and the cyan deposition amounts MC of the printed matter, obtaining FIG. 18 that corresponds to FIG. 9. Listed in FIG. 18 are values of the on-medium deposition amount of the toner T on the sheet P, specifically the sum of the brilliant deposition amount MS and the cyan deposition amount MC as the total deposition amount U. Further listed in FIG. 18 are values of the ratio of the cyan deposition amount MC to the brilliant deposition amount MS, specifically the cyan deposition amount MC divided by the brilliant deposition amount MS, as the deposition amount ratio R in the individual combinations.

Figures 19, 20:
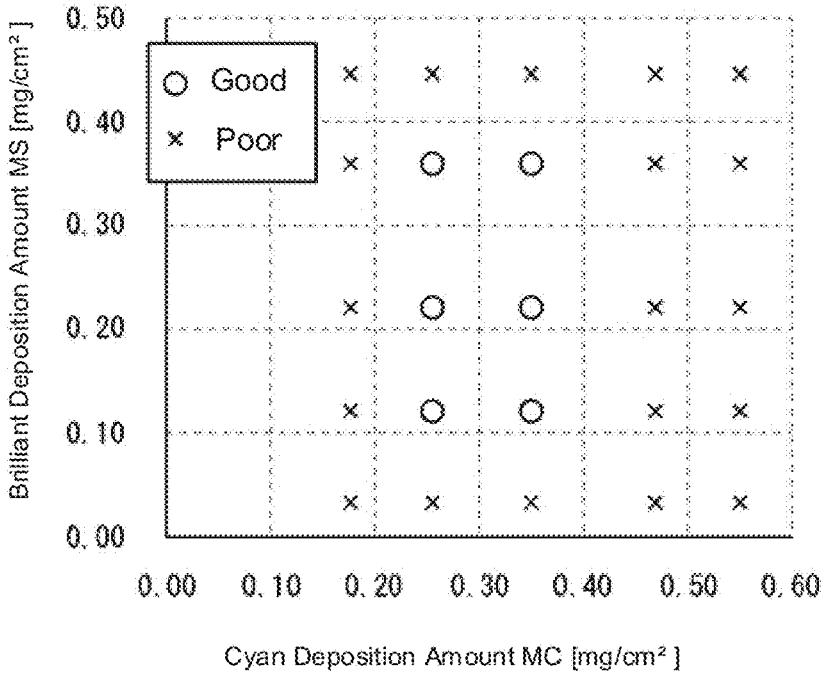
FIG. 19 is a plot showing the distribution of metallic color expressibility evaluations according to on-medium deposition amounts when using the cyan toner.
FIG. 20 is a table listing metallic color expressibility evaluations when using the cyan toner and restricting the deposition amount ratio.

Further in this evaluation, the codes indicating the evaluation results in the individual combinations were plotted with the cyan deposition amount MC as the horizontal axis and the brilliant deposition amount MS as the vertical axis, obtaining a distribution characteristic as shown in FIG. 19 that corresponds to FIG. 10.

Referring to FIG. 18, it is evident that when the brilliant deposition amount MS was 0.12 [mg/cm$^2$] or higher and 0.36 [mg/cm$^2$] or lower, and the cyan deposition amount MC was 0.26 [mg/cm$^2$] or higher and 0.36 [mg/cm$^2$] or lower, metallic color expressibility was evaluated as high, and the image quality of the printed matter was good. It is also evident that combinations evaluated as high in metallic color expressibility are in a region approximately drawing a rectangle in the distribution characteristic of FIG. 19.

It is further evident in FIG. 18 that when the brilliant deposition amount MS was set to 0.22 [mg/cm$^2$], metallic color expressibility was evaluated as high. The deposition amount ratio R in this case was 1.18 or 1.64. Then, in this evaluation, evaluations on the total deposition amount U were performed by restricting the deposition amount ratio R value based on the combinations evaluated as high in metallic color expressibility.

Specifically, in this evaluation, 12 kinds of printed matter were prepared by fixing the deposition amount ratio R to 1.18 or 1.64, and changing the brilliant deposition amount MS and the cyan deposition amount MC, accompanied by various changes in the total deposition amount U. In addition, in this evaluation, individual pieces of printed matter were also prepared in cases where the deposition amount ratio R was intentionally set outside the range of 1.18 or higher and 1.64 or lower, specifically cases where the deposition amount ratio R was set to 1.09 and 1.81.

In this evaluation, for the images of the total 14 kinds of printed matter prepared in this manner, metallic color expressibility was evaluated in the same manner as the above-mentioned case, and the results were summarized in a table similar to FIG. 18, obtaining FIG. 20 that corresponds to FIG. 11. In this FIG. 20, in the same manner as in the case of FIG. 18, when the image quality was good, the code "○" was written as a high evaluation, and when the image quality was bad, the code "x" was written as a low evaluation.

Referring to FIG. 20, it is evident that when the deposition amount ratio R (=the cyan deposition amount MC/the brilliant deposition amount MS) was 1.18 or higher and 1.64 or lower, and the total deposition amount U (=the brilliant deposition amount MS+the cyan deposition amount MC) was 0.07 [mg/cm$^2$] or higher and 0.72 [mg/cm$^2$] or lower, metallic color expressibility was evaluated as high.

According to this FIG. 20, when expressing a metallic color by superimposing the brilliant toner TS and the cyan toner TC on the sheet P, the total deposition amount U that is the sum of their toner amounts needs to be suppressed lower than the toner amount when using only the cyan toner TC (that is, the cyan deposition amount MC).

Other than this, in this evaluation, cases of using the brilliant toners TSc, TSd, TSe, and TSf substituting for the brilliant toner TSa were evaluated in the same manner, obtaining the same evaluation results as in the case of using the brilliant toner TSa.

Thus, according to this evaluation, it has become evident that when using the cyan toner TC, if the deposition amount ratio R is 1.18 or higher and 1.64 or lower, and the total deposition amount U is 0.07 [mg/cm$^2$] or higher and 0.69 [mg/cm$^2$] or lower, a metallic color can be expressed well, and a good image quality can be obtained.

[4-5. Evaluation Using Cloth Medium]

In this evaluation, metallic color expressibility was evaluated in a case of performing a special medium print process that transfers an image (that is, a toner image) printed on a dedicated medium by the image forming apparatus 1 further onto a special medium such as a T shirt. This special medium print process is also called T-shirt printing.

Figures 21A, 21B, 21C:
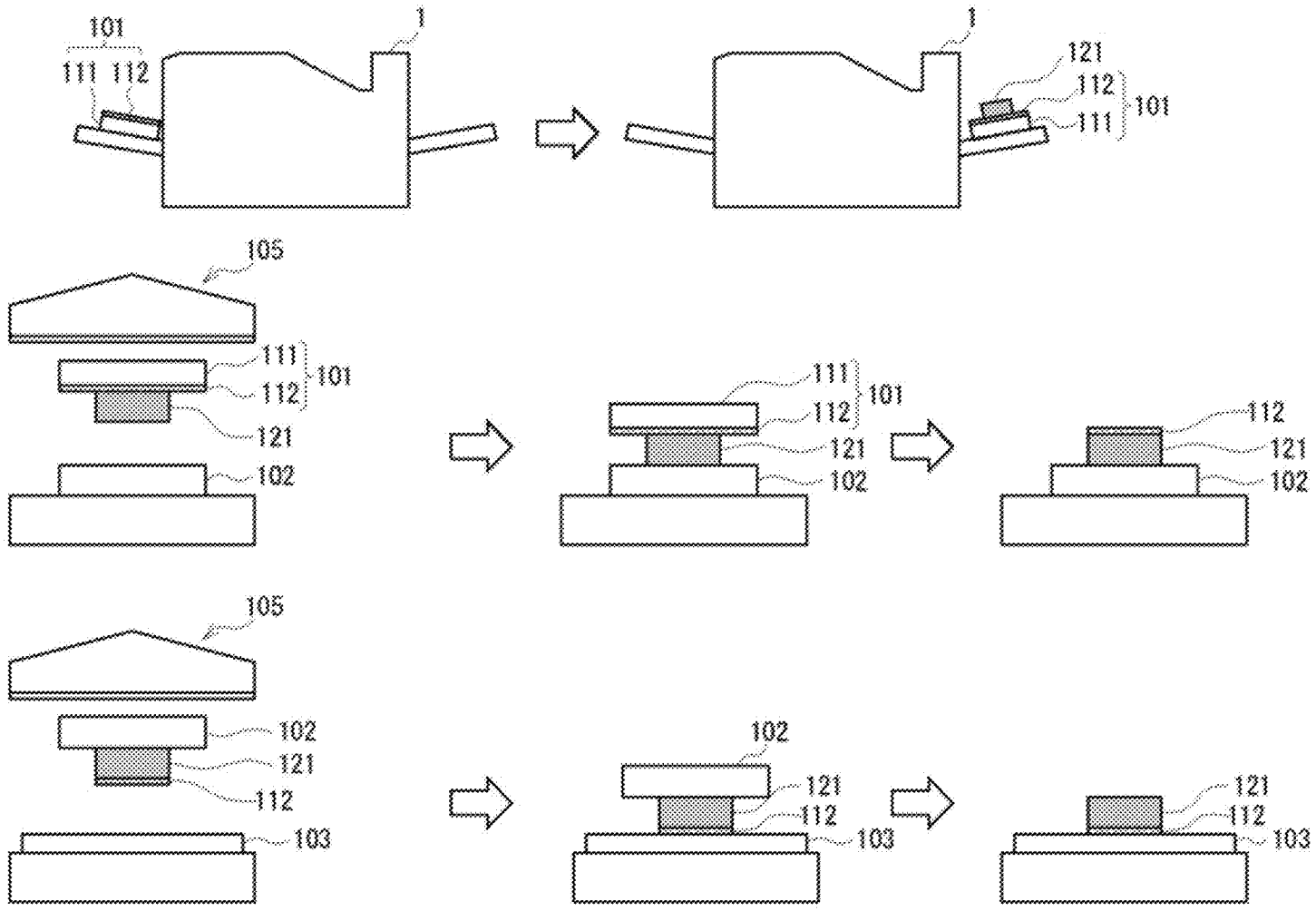
FIGS. 21A-21C are schematic diagrams showing image printing by a special medium print process.

In this special medium print process, as schematic diagrams are shown in FIGS. 21A-21C, other than the image forming apparatus 1 (FIG. 1) are two kinds of media, an M sheet 101 and a T sheet 102, and a special medium 103 to which the image is finally transferred are used, and also a heat press machine 105 that applies heat to the medium is used.

The M sheet 101 and the T sheet 102 are, for example, WoW 7.8 (manufactured by TheMagicTouch GmbH). Among these, the M sheet 101 has a configuration where an adhesive layer 112 is laminated on one face of a backing sheet 111. The special medium 103 is, for example, T-shirt 5806-01 (cotton 100[%], black, manufactured by DelaWEAR Clothing Co.). The heat press machine 105 is model 234 (manufactured by TheMagicTouch GmbH), and can apply pressure and heat with an object nipped in the up-down direction. Also, the heat press machine 105 can have temperature, pressure, time, etc. set.

Specifically, performed in the special medium print process are an image forming process to form an image using the toners as shown in FIG. 21A, a first transfer process to perform the first transfer process as shown in FIG. 21B, and a second transfer process to perform the second transfer process as shown in FIG. 21C.

Among these, in the first image forming process (FIG. 21A), a toner image 121 is formed by the image forming apparatus 1, and the toner image 121 is transferred to the face of the M sheet 101 where the adhesive layer 112 is laminated. In this case, used in the image forming apparatus 1 are the same settings of various print conditions and toner weight as in the case of using the above-mentioned coated paper (OS coated paper W, weight 127 [g/m$^2$]).

In the subsequent first transfer process (FIG. 21B), heat and pressure are applied by the heat press machine 105 in a state of having the toner image 121 on the M sheet 101 oppose the T sheet 102. At this time, in the heat press machine 105, pressure is set to "Dial 8", temperature to 150-155 [° C.], and time to 40 seconds. Thereby, the surface of the toner image 121 is fused to the T sheet 102. Afterwards, once the M sheet 101 is peeled off the T sheet 102, the toner image 121 remains on the T sheet 102 side, and further the adhesive layer 112 of the M sheet 101 is peeled off the backing sheet 111 and remains on the toner image 121 side.

In the last second transfer process (FIG. 21C), heat and pressure are applied by the heat press machine 105 in a state of having the toner image 121 transferred to the T sheet 102 oppose the special medium 103. At this time, in the heat press machine 105, pressure is set to "Dial 8", temperature to 130-135 [° C.], and time to 5 seconds. Thereby, the toner image 121 is fused to the special medium 103 by the adhesive layer 112. Afterwards, once the T sheet 102 is peeled off the special medium 103, achieved is a state where the toner image 121 (that is, the image) is transferred to the special medium 103.

In this evaluation, a brilliance superimposed toner image (FIG. 4) was formed by the brilliance superimposing print process in the first image forming process (FIG. 21A), it was transferred to the special medium 103, and its metallic color expressibility was evaluated. As the result, in this evaluation, the same evaluation result as in the case of forming the brilliance superimposed toner image on the above-mentioned coated paper (OS coated paper W, weight 127 [g/m$^2$]).

5. Conditions in Brilliance Superimposing Print Process

Based on the above evaluation results, in the image forming apparatus 1, when performing the brilliance superimposing print process (FIG. 4) that superimposes a brilliant toner image IS over a color toner image IL, the on-medium deposition amounts of the color toner TL and the brilliant toner TS are individually controlled.

Specifically, as shown in FIG. 22, the controller 3 has a prescribed memory part (not shown) store a control table TBL1 where the individual colors of the color toners TL and the conditions on the total deposition amount U and the deposition amount ratio R are associated, and controls the on-medium deposition amounts according to this control table TBL1.

That is, it is regulated in the control table TBL1 that when using the yellow toner TY, the deposition amount ratio R (=the yellow deposition amount MY/the brilliant deposition amount MS) should be 1.17 or higher and 2.92 or lower, and the total deposition amount U (=the brilliant deposition amount MS+the yellow deposition amount MY) should be 0.07 [mg/cm$^2$] or higher and 0.47 [mg/cm$^2$] or lower.

Also, it is regulated in the control table TBL1 that when using the black toner TK, the deposition amount ratio R (=the black deposition amount MK/the brilliant deposition amount MS) should be 1.27 or higher and 1.50 or lower, and the total deposition amount U (=the brilliant deposition amount MS+the black deposition amount MK) should be 0.07 [mg/cm$^2$] or higher and 0.69 [mg/cm$^2$] or lower.

Furthermore, it is regulated in the control table TBL1 that when using the magenta toner TM, the deposition amount ratio R (=the magenta deposition amount MM/the brilliant deposition amount MS) should be 1.32 or higher and 1.50 or lower, and the total deposition amount U (=the brilliant deposition amount MS+the magenta deposition amount MM) should be 0.07 [mg/cm$^2$] or higher and 0.69 [mg/cm$^2$] or lower.

Furthermore, it is regulated in the control table TBL1 that when using the cyan toner TC, the deposition amount ratio R (=the cyan deposition amount MC/the brilliant deposition amount MS) should be 1.18 or higher and 1.64 or lower, and the total deposition amount U (=the brilliant deposition amount MS+the cyan deposition amount MC) should be 0.07 [mg/cm$^2$] or higher and 0.72 [mg/cm$^2$] or lower.

When performing the brilliance superimposing print process, the controller 3 performs a prescribed arithmetic processing based on the image to be printed (that is, image data), thereby recognizing colors contained in the image and their on-medium deposition amounts. Then, the controller 3 determines the brilliant deposition amount MS so that both the deposition amount ratios R and the total deposition amounts U satisfy the regulations in the control table TBL1 according to the recognized colors and the color deposition amounts ML.

Also, to summarize the conditions on the deposition amount ratio R and the total deposition amount U that are common to all the colors, the deposition amount ratio R (=the color deposition amount ML/the brilliant deposition amount MS) becomes 1.32 or higher and 1.50 or lower, and the total deposition amount U (=the brilliant deposition amount MS+the color deposition amount ML) becomes 0.07

[mg/cm$^2$] or higher and 0.47 [mg/cm$^2$] or lower. Then, when a plurality of colors as the color toners TL are superimposed, as shown in the bottom row of FIG. 22, the controller 3 individually controls the on-medium deposition amounts of the color toners TL (these are hereafter called the color deposition amounts ML) and the brilliant deposition amount MS so as to obtain printed matter that satisfies these conditions.

In this manner, when controlling the color deposition amounts ML and the brilliance deposition amount MS, the controller 3 only needs to have the items for the color toner TL in the bottom row stored in the control table TBL1 stored in the prescribed memory part (not shown). Thereby, the controller 3 can suppress a necessary memory capacity low compared with the case of storing items for all the color toners T in the control table TBL1.

Also, in controlling the color deposition amounts ML and the brilliant deposition amount MS in this manner, when using the black toner TK, the magenta toner TM, and the cyan toner TC, the controller 3 sets the upper limit value of their deposition amounts U to a lower value (0.47 [mg/cm$^2$]) than those when each of them is used as a single color (0.69~0.72 [mg/cm$^2$]). That is, compared with the case of using the upper limit values of the total deposition amounts U of the individual toners T when used as a single color, the image forming apparatus 1 can express metallic colors well and obtain a good image quality while suppressing the total deposition amounts U low.

6. Efficacy Etc.

In the above configuration, when performing the brilliance superimposing print process (FIG. 4), the image forming apparatus 1 of this embodiment has the controller 3 individually control the on-medium deposition amounts of the color toners TL and the brilliant toner TS so as to satisfy the conditions on the deposition amount ratios R and the total deposition amounts U regulated in the control table TBL1 (FIG. 2).

In the image forming apparatus 1, by restricting the range of the on-deposition amount ratios R, especially regulating the lower limit values, it can prevent a situation where the amounts of the color toners TL become too low relative to the amount of the brilliant toner TS, disabling sufficient expression of color vividness. Also, in the image forming apparatus 1, by restricting the range of the deposition amount ratios R, especially regulating the upper limit values, it can prevent a situation where the amounts of the color toners TL become too high relative to the amount of the brilliant toner TS, aluminum pieces in the color toners TL are buried, and brilliance becomes insufficient.

Furthermore, in the image forming apparatus 1, by restricting the range of the total deposition amounts U, especially regulating the upper limit values, it can prevent a situation where the toner T becomes too much on the sheet P and difficult to be melted at the time of fusing, worsening surface smoothness and decreasing glossiness in the fused image. Also, in the image forming apparatus 1, by restricting the range of the total deposition amounts U, especially regulating the lower limit values, it can prevent a situation where the toner T becomes too little, and blurring occurs in the image.

As a result, in the image forming apparatus 1, by appropriately setting the ranges of the deposition amount ratios R and the total deposition amounts U individually, both color vividness reproduction and brilliance expression can be realized well, and the image surface can be smoothly finished, maintaining glossiness and preventing blurring from occurring. In other words, the image forming apparatus 1 enhances metallic color expressibility by expressing metallic luster with the brilliant toner TS while maintaining color vividness with the color toners TL.

Also, in the image forming apparatus 1, because various properties of the color toners TL differ by color due to differences in raw material and manufacturing method, the ranges of the deposition amount ratios R and the total deposition amounts U were regulated by colors of the individual color toners TL (FIG. 22). Thereby, the image forming apparatus 1 can control the color deposition amounts ML and the brilliant deposition amount MS to the optimal values for the individual colors, enhancing metallic color expressibility in every color.

By the way, in general, when an image is formed on the sheet P using a brilliant toner TS by an image forming apparatus, depending on the aluminum content of the brilliant toner TS, the image quality may decline.

Aluminum is a metallic material with high conductivity. Therefore, in an image forming apparatus, when a brilliant toner TS containing this aluminum is charged, the charge can easily escape, and the brilliant toner TS may not be sufficiently charged. Also, in the brilliant toner TS, because the average particle size of aluminum pieces is relatively large, the aluminum pieces may not be contained in the toner base particles, being at least partially exposed. In such a case, in the image forming apparatus, the charge of the brilliant toner TS can escape even more easily, making it insufficiently charged.

As a result, the charge amount of the brilliant toner TS decreases, thereby the image forming apparatus becomes unable to transfer properly a toner image formed on the photosensitive drum to the sheet P, decreasing the quality of an image formed on the sheet P.

Then, in the image forming apparatus, although decreasing the aluminum content in the brilliant toner TS can be considered, in such a case, because brilliance in the image formed on the sheet P would decrease, the image quality would decline. Also, in the image forming apparatus, although decreasing the average particle size of a brilliant pigment in the brilliant toner TS can be considered, in such a case, because brilliance in the image would also decrease accompanying the decrease in the average particle size, the image quality would decline.

Based on these, in this embodiment, the brilliant toner TS was prepared by a dissolution suspension method. Thereby, in this embodiment, compared with a case of preparing the brilliant toner TS by a pulverization method, it becomes easier to contain aluminum pieces in the toner base particles, making it harder for a charge to escape. As a result, in this embodiment, it becomes unnecessary to decrease the aluminum contents of the brilliant toner TS or decrease the average particle size of the brilliant pigment in the brilliant toner TS, allowing to avoid an image quality decline as a result.

According to the above configuration, when performing the brilliance superimposing print process, the image forming apparatus 1 by this embodiment has the controller 3 control individually the on-medium deposition amounts of the color toners TL and the brilliant toner TS so as to contain the deposition amount ratios R and the total deposition amounts U within their prescribed ranges. Thereby, the image forming apparatus 1 can realize well enhancing metallic color expressibility, that is, both color vividness reproduction and brilliance expression in printed images, finishing the image surface smoothly, maintaining glossiness and preventing the occurrences of blurring as well.

7. Other Embodiments

Note that in the above-mentioned embodiments, in the blurring evaluation (FIG. 8), the lower limit value of the brilliant deposition amounts MS with which a high evaluation was obtained was 0.03 [mg/cm$^2$], and the lower limit value of the color deposition amounts ML with which a high evaluation was for obtained was 0.04 [mg/cm$^2$], therefore mentioned was a case of setting their sum 0.07 [mg/cm$^2$] as the lower limit value of the total deposition amount U (FIG. 22). However, this invention is not limited to this, but for example the lower limit value of the total deposition amount U can be determined based on the lower limit values of the brilliant deposition amounts MS and the color deposition amounts ML with which a high evaluation can be obtained when using other kinds of brilliant toner TS and color toners TL.

Furthermore, mentioned in the above-mentioned embodiments, was a case where based on the condition common to all colors in the control table TBL1 of FIG. 22, the deposition amount ratio R was set to 1.32 or higher and 1.50 or lower, and the total deposition amount U was set to 0.07 [mg/cm$^2$] or higher and 0.47 [mg/cm$^2$] or lower. However, this invention is not limited to this, but for example, based on a condition satisfied by at least one of the colors in the control table TBL1 of FIG. 22, the deposition amount ratio R and the total deposition amount U can be regulated into various ranges, such as setting the deposition amount ratio R to 1.17 or higher and 2.92 or lower and the total deposition amount U to 0.07 [mg/cm$^2$] or higher and 0.72 [mg/cm$^2$] or lower.

Also, mentioned in the above-mentioned embodiments was a case where tiny thin pieces of aluminum were contained as a pigment in the brilliant toner TS. However, this invention is not limited to this, but tiny thin pieces made of other various materials can be contained as a pigment.

Furthermore, mentioned in the above-mentioned embodiments was a case of using the brilliant toner TS expressing silver color. However, this invention is not limited to this, but a brilliant toner expressing another color such as gold can be used. A gold brilliant toner can be manufactured by adding, other than a metallic pigment made of aluminum pieces for example, a yellow pigment, a magenta pigment, a red-orange fluorescent dye, and yellow fluorescent dye. In this case, an organic pigment C. I. Pigment Yellow 180 can be used as the yellow pigment for example, and also an organic pigment C. I. Pigment Red 122 can be used as the magenta pigment for example. Also, FM-34N Orange (manufactured by SINLOIHI Co., Ltd.) can be used as the red-orange fluorescent dye for example, and FM-35N Yellow (manufactured by SINLOIHI Co., Ltd.) can be used as the yellow fluorescent dye for example.

Furthermore, mentioned in the above-mentioned embodiments was a case of using the toner T as a one-component developer. However, this invention is not limited to this, but the toner T can be used as a two-component developer used with a carrier for example.

Furthermore, mentioned in the above-mentioned embodiments was a case where the on-medium deposition amount was increased or decreased by increasing or decreasing the bias voltages applied to the individual parts. However, this invention is not limited to this, but only the bias voltages applied to the first supply roller 32 and the second supply roller 33 (FIG. 2) can be increased or decreased, or only the bias voltages applied to the development roller 34, the first supply roller 32, and the second supply roller 33 can be increased or decreased for example.

Furthermore, in the above-mentioned embodiment, based on the toner T densities detected by the density sensor DS (FIG. 1), density corrections were performed by feedback controls of the bias voltages etc. in the individual image forming units 10. Then, mentioned in this embodiment was a case where the on-medium deposition amounts in the individual color toner images transferred to the sheet P were calculated, and the on-medium deposition amounts of color toner TL and brilliant toner TS were individually controlled based on the obtained values. However, this invention is not limited to this, but the on-medium deposition amount according to the bias voltage applied to the development roller 34 (FIG. 2) can be experimentally calculated for each image forming unit 10, and a table expressing the relation between this bias voltage and the on-medium deposition amount can be stored in the memory part (not shown) of the controller 3. In this case, the controller 3 can individually control the on-medium deposition amounts of color toner TL and brilliant toner TS using this table.

Furthermore, mentioned in the above-mentioned embodiments was a case of installing the five image forming units 10 in the image forming apparatus 1 (FIG. 1). However, this invention is not limited to this, but four or fewer or six or more image forming units 10 can be installed in the image forming apparatus 1.

Furthermore, mentioned in the above-mentioned embodiments was a case of applying this invention to the image forming apparatus 1 that was a single-function printer. However, this invention is not limited to this but can be applied to image forming apparatuses having other various functions, such as an MFP (Multifunction Peripheral) having functions of a copier, a facsimile machine, etc.

Furthermore, mentioned in the above-mentioned embodiments was a case of applying this invention to the image forming apparatus 1. However, this invention is not limited to this but can be applied to various electronic equipment such as a copier that forms an image on a medium such as the sheet P using the toner T by an electrophotographic method.

Furthermore, this invention is not limited to the above-mentioned embodiments or other embodiments. That is, the scope of application of this invention includes embodiments that arbitrarily combine part or the whole of the above-mentioned embodiments and other embodiments, and embodiments that extract part of them.

Furthermore, mentioned in the above-mentioned embodiments was a case of configuring the image forming apparatus 1 as an image forming apparatus of the image forming unit 10S as a brilliant image forming part, the image forming units 10K, 10C, 10M, and 10Y as a color image forming part, the secondary transfer part 49 as a transfer part, and the controller 3 as a controller. However, this invention is not limited to this, but the image forming apparatus can be configured of a brilliant image forming part, a color image forming part, a transfer part, and a controller in any other various configurations.

In the above embodiments, the optical densities (ODs) were measured at 1.40. It is not necessary to strictly limit to the number in order to realize the invention. These optical densities may increase or decrease by 10% or more. Putting it other way, for the instant invention, the optical densities may be about 1.4, and "about 1.4" of the optical density means to range from 1.26 to 1.54. Further, it is preferred to individually set the optical densities for tonners; 1.3 to 1.7 for black, 1.2 to 1.6 for yellow, 1.2 to 1.6 for magenta and 1.2 to 1.6 for cyan. They are preferred ranges for these tonners.

This invention can be utilized in forming an image on a medium by superimposing a brilliant toner image on a color toner image by an electrophotographic method.

What is claimed is:

1. An image forming apparatus for performing an image forming process, comprising:

a brilliant image forming part that forms a brilliant toner image using a brilliant toner wherein the brilliant toner is used at a brilliant deposition amount (MS) for forming the brilliant toner image, the brilliant deposition amount being defined by a used weight of the brilliant toner per unit area, a color image forming part that forms a color toner image using a color toner wherein the color toner is used at a color deposition amount (ML) for forming the color toner image, the color deposition amount being defined by a used weight of the color toner per unit area, a transfer part that transfers the brilliant toner image and the color toner image to a medium, and a controller that controls the brilliant deposition amount of the brilliant toner and the color deposition amount of the color toner on the medium, wherein when the brilliant toner image is to be superimposed over the color toner image on the medium, the controller adjusts the brilliant deposition amount for the brilliant toner image in correspondence with a color type and the color deposition amount ML of the color toner that has been used for the color toner image.

2. The image forming apparatus according to claim 1, wherein the brilliant toner has a metallic pigment having flat-shape particles, and its aluminum element content measured by an energy dispersive fluorescent X-ray analyzer is 6.7% or higher and 17.2% or lower.

3. The image forming apparatus according to claim 1, further comprising:

a density sensor that detects density of the brilliant toner image and the color toner image transferred onto the transfer part, wherein the controller controls each of the brilliant deposition amount and the color deposition amount based on the detection by the density sensor.

4. An image forming apparatus for performing an image forming process, comprising:

a brilliant image forming part that forms a brilliant toner image using a brilliant toner wherein the brilliant toner is used at a brilliant deposition amount (MS) for forming the brilliant toner image, the brilliant deposition amount being defined by a used weight of the brilliant toner per unit area, a color image forming part that forms a color toner image using a color toner wherein the color toner is used at a color deposition amount (ML) for forming the color toner image, the color deposition amount being defined by a used weight of the color toner per unit area, a transfer part that transfers the brilliant toner image and the color toner image to a medium, and a controller that controls the brilliant deposition amount of the brilliant toner and the color deposition amount of the color toner on the medium, wherein in a case where the brilliant toner image is to be superimposed over the color toner image on the medium, the brilliant deposition amount MS is 0.03 mg/cm$^2$ or higher, and the color deposition amount ML is 0.04 mg/cm$^2$ or higher, the controller performs the image forming process to satisfy following equations (1) and (2):

$$1.17 \leq ML/MS \leq 2.92 \quad (1)$$

$$0.07 \leq MS+ML \leq 0.72 \quad (2).$$

5. The image forming apparatus according to claim 4, wherein in a case where the color tonner is a black toner of which the color type is black, the controller performs the image forming process to satisfy following equations (3) and (4):

$$1.27 \leq ML/MS \leq 1.50 \quad (3)$$

$$0.07 \leq MS+ML \leq 0.69 \quad (4).$$

6. The image forming apparatus according to claim 5, wherein the black toner has an optical density of about 1.4 if the color deposition amount ML is 0.40 mg/cm$^2$ or higher and 0.50 mg/cm$^2$ or lower.

7. The image forming apparatus according to claim 4, wherein in a case where the color tonner is a yellow toner of which the color type is yellow, the controller performs the image forming process to satisfy following equations (5) and (6):

$$1.17 \leq ML/MS \leq 2.92 \quad (5)$$

$$0.07 \leq MS+ML < 0.47 \quad (6).$$

8. The image forming apparatus according to claim 7, wherein the yellow toner has an optical density of about 1.4 if the color deposition amount ML is 0.40 mg/cm$^2$ or higher and 0.50 mg/cm$^2$ or lower.

9. The image forming apparatus according to claim 4, wherein in a case where the color tonner is a cyan toner of which the color type is cyan, the controller performs the image forming process to satisfy following equations (7) and (8):

$$1.18 \leq ML/MS \leq 1.64 \quad (7)$$

$$0.07 \leq MS+ML \leq 0.72 \quad (8)$$

10. The image forming apparatus according to claim 9, wherein the cyan toner has an optical density of about 1.4 if the color deposition amount ML is 0.40 mg/cm$^2$ or higher and 0.50 mg/cm$^2$ or lower.

11. The image forming apparatus according to claim 4, wherein in a case where the color tonner is a magenta toner of which the color type is magenta, the controller performs the image forming process to satisfy following equations (9) and (10):

$$1.32 \leq ML/MS \leq 1.50 \quad (9)$$

$$0.07 \leq MS+ML \leq 0.69 \quad (10).$$

12. The image forming apparatus according to claim 11, wherein the magenta toner has an optical density of about 1.4 if the color deposition amount ML is 0.45 mg/cm$^2$ or higher and 0.55 mg/cm$^2$ or lower.

13. The image forming apparatus according to claim 4, wherein the controller performs the image forming process to further satisfy following equations (11) and (12):

$$1.32 \leq ML/MS \leq 1.50 \quad (11)$$

$$0.07 \leq MS+ML \leq 0.47 \quad (12).$$

14. The image forming apparatus according to claim 4, wherein the color image forming part that forms the color toner image using two more color toners each of which is a different color type and has a predetermined deposition amount from the other color toners, in the case where the brilliant toner image is to be superimposed over the color toner image on the medium, the controller considers only one of the three color toners and the color deposition amount of the one of the three color toners in order to satisfy the equations (1) and (2).

15. The image forming apparatus according to claim 4, wherein the color image forming part that forms the color toner image using two more color toners each of which is a different color type and has a predetermined deposition amount from the other color toners, in the case where the brilliant toner image is to be superimposed over the color toner image on the medium, the controller considers all the three color toners and the color deposition amounts of the three color toners in order to satisfy the equations (1) and (2).

16. The image forming apparatus according to claim 4, wherein the brilliant image forming part is configured with a photosensitive drum that has a photosensitive circumference, a charging roller that evenly charges the photosensitive circumference, a development roller that creates a latent image on the circumference of the photosensitive drum, and a supply roller that supplies the tonner to develop the latent image with the tonner, a development roller, the controller increases absolute values of bias voltages that are applied to the development roller and the supply roller in order to increase the brilliant deposition amount MS, the controller decreases absolute values of bias voltages that are applied to the development roller and the supply roller in order to decrease the brilliant deposition amount MS.

17. The image forming apparatus according to claim 4, wherein the brilliant toner has a metallic pigment having flat-shape particles, and its aluminum element content measured by an energy dispersive fluorescent X-ray analyzer is 6.7% or higher and 17.2% or lower.

18. An image forming method for superimposing a brilliant toner image using a brilliant toner over a color toner image using a color toner on a medium, comprising:

an acquisition step that acquires a color type of the color toner and a color deposition amount (ML) that is defined by a used weight of the color toner per unit area, which has been used on the medium, and a determination step that determines a brilliant deposition amount (MS) that is defined by a used weight of the brilliant toner per unit area, which is to be used on the medium in consideration of the color type of the color toner and the color deposition amount, an adjustment step that adjusts an absolute value of bias voltage to be applied to form the brilliant toner image, and a forming step that forms the brilliant toner image over the color toner image using the bias voltage, which is adjusted at the adjustment step, such that the brilliant deposition amount of the brilliant toner over the color toner either increases or decreases in correspondence with the bias voltage.

19. The image forming method according to claim 18, wherein in a case where the brilliant deposition amount MS is 0.03 $mg/cm^2$ or higher, and the color deposition amount ML is 0.04 $mg/cm^2$ or higher, the adjustment step executes to satisfy following equations:

$$1.17 \leq ML/MS \leq 2.92,$$

$$0.07 \leq MS+ML \leq 0.72.$$

* * * * *